US007982404B2

(12) United States Patent
Gordin

(10) Patent No.: US 7,982,404 B2
(45) Date of Patent: Jul. 19, 2011

(54) METHOD AND APPARATUS AND SYSTEM FOR ADJUSTING POWER TO HID LAMP TO CONTROL LEVEL OF LIGHT OUTPUT AND CONSERVE ENERGY (BALLAST MULTI-TAP POWER OUTPUT)

(75) Inventor: Myron K. Gordin, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 521 days.

(21) Appl. No.: 11/932,560

(22) Filed: Oct. 31, 2007

(65) Prior Publication Data

US 2008/0150451 A1 Jun. 26, 2008

Related U.S. Application Data

(60) Provisional application No. 60/871,629, filed on Dec. 22, 2006.

(51) Int. Cl.
*H05B 41/16* (2006.01)

(52) U.S. Cl. ..... 315/144; 315/227 R; 315/278; 315/362

(58) Field of Classification Search ..... 315/137, 315/141–146, 227 R, 278, 288, 291, 299, 315/362, 239, 240, 244
See application file for complete search history.

(56) References Cited

U.S. PATENT DOCUMENTS

| | | | | | |
|---|---|---|---|---|---|
| 3,558,902 | A | * | 1/1971 | Casey | 307/3 |
| 4,292,570 | A | | 9/1981 | Engel | |
| 4,384,239 | A | * | 5/1983 | Davenport | 315/282 |
| 4,431,948 | A | * | 2/1984 | Elder et al. | 315/276 |
| 4,434,388 | A | | 2/1984 | Carver et al. | |
| 4,501,994 | A | | 2/1985 | Spreadbury | |
| 4,651,061 | A | * | 3/1987 | Spissinger | 315/200 R |
| 4,891,562 | A | | 1/1990 | Nuckolls et al. | |
| 4,924,109 | A | | 5/1990 | Weber | |
| 4,931,701 | A | | 6/1990 | Carl | |
| 4,994,718 | A | | 2/1991 | Gordin | |
| 5,477,113 | A | * | 12/1995 | Christoffersson | 315/278 |
| 5,519,286 | A | | 5/1996 | Rodrigues et al. | |
| 6,031,340 | A | | 2/2000 | Brosius | |
| 6,075,326 | A | | 6/2000 | Nostwick | |
| 6,191,568 | B1 | | 2/2001 | Poletti | |

(Continued)

FOREIGN PATENT DOCUMENTS

CA 1288803 9/1991

(Continued)

OTHER PUBLICATIONS

Venture Lighting International, Range of Metal Halide Lumen Maintenance, HID Systems Sourcebook, 2000, p. 143.

(Continued)

*Primary Examiner* — Thuy Vinh Tran
(74) *Attorney, Agent, or Firm* — McKee, Voorhees & Sease, P.L.C.

(57) ABSTRACT

One aspect of the present invention is a non-electronic method of controlling the power provided to the lamp through use of multiple secondary taps off the secondary side of the HID ballast. This allows for a base capacitor to be used, along with the multiple secondary taps of the ballast, to vary the power to the lamp for purposes of providing constant light output, dimming capabilities, or to hold the power constant, or any combination of such.

46 Claims, 25 Drawing Sheets

U.S. PATENT DOCUMENTS

| | | | | |
|---|---|---|---|---|
| 6,316,923 | B1 | 11/2001 | Poletti | |
| 6,515,430 | B2 | 2/2003 | Kayser | |
| 6,545,429 | B1 | 4/2003 | Flory, IV | |
| 6,545,433 | B2 | 4/2003 | Beij et al. | |
| 6,577,075 | B2 | 6/2003 | Romano et al. | |
| 6,583,574 | B2 * | 6/2003 | Ann et al. | 315/149 |
| 6,681,110 | B1 | 1/2004 | Crookham et al. | |
| 6,774,768 | B2 * | 8/2004 | Flory, IV | 340/309.16 |
| 6,798,153 | B2 | 9/2004 | Mattas et al. | |
| 6,906,476 | B1 * | 6/2005 | Beatenbough et al. | 315/276 |
| 7,038,390 | B2 * | 5/2006 | Swami et al. | 315/112 |
| 7,148,781 | B2 * | 12/2006 | Beausoleil | 336/150 |
| 7,176,635 | B2 * | 2/2007 | Gordin et al. | 315/226 |
| 7,385,360 | B2 | 6/2008 | Dluzniak | |
| 7,514,878 | B2 * | 4/2009 | Crandall et al. | 315/224 |
| 7,675,251 | B2 | 3/2010 | Gordin | |
| 2006/0071610 | A1 | 4/2006 | Dluzniak | |
| 2007/0040513 | A1 | 2/2007 | Cleland et al. | |
| 2007/0043540 | A1 | 2/2007 | Cleland et al. | |
| 2007/0043541 | A1 | 2/2007 | Cleland et al. | |

FOREIGN PATENT DOCUMENTS

| | | | |
|---|---|---|---|
| DE | 195 40 326 | A1 | 10/1995 |
| DE | 199 12 517 | A1 | 9/2000 |
| EP | 0 536 877 | B1 | 4/1993 |
| EP | 0 669 788 | A1 | 8/1995 |
| JP | 6-163163 | | 6/1994 |
| TW | 079104968 | | 6/1990 |
| TW | 091123285 | | 7/2004 |

OTHER PUBLICATIONS

Venture Lighting International, Venture's Technical Information, Ballasts(c) 2006, and Ballast Types(c) 2006 (6 pages).

English language abstract of JP6-163163.

English language translation of DE 195 40 326.

English language translation of DE 199 12 517.

English language translation of TW 079104968.

* cited by examiner

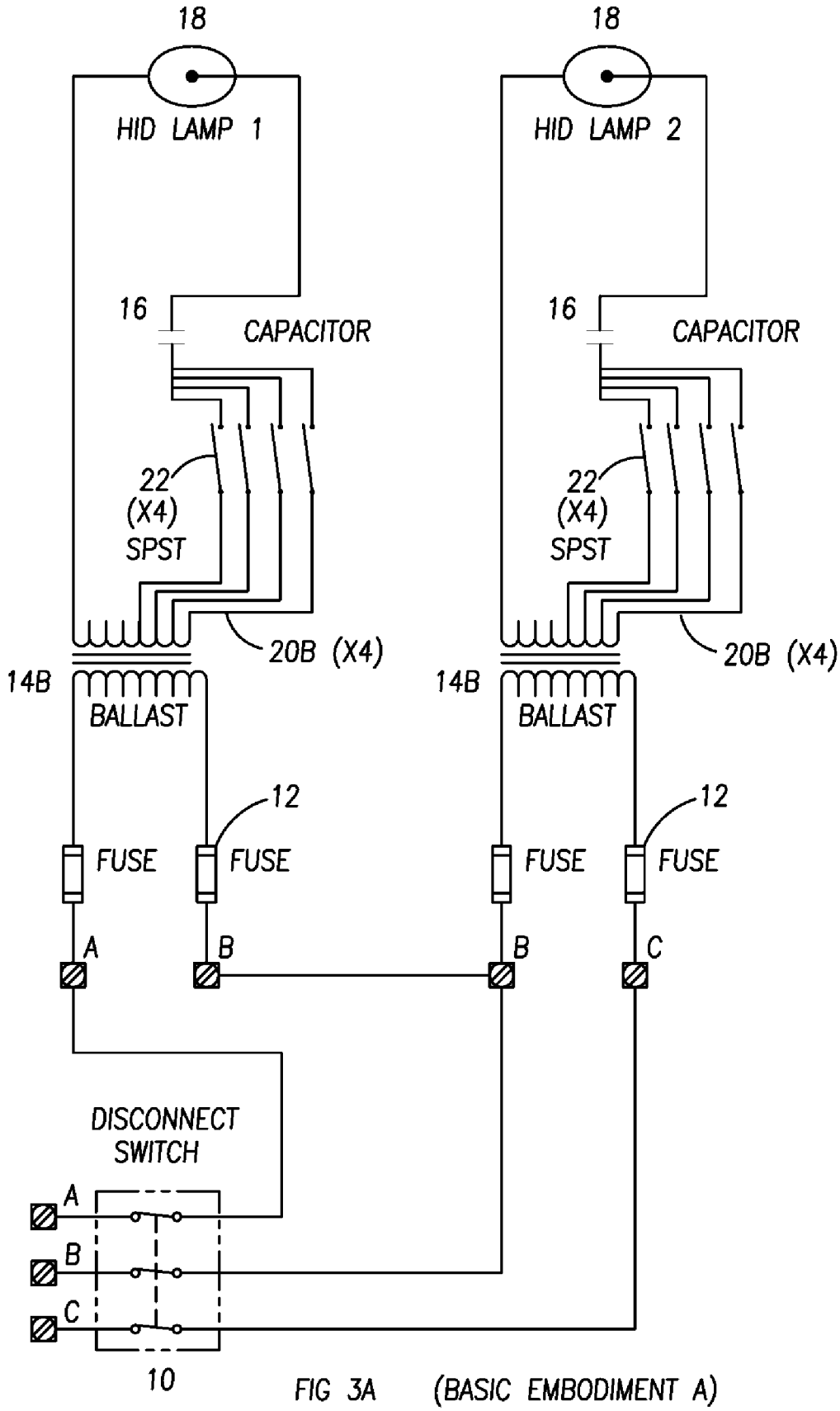
FIG 3A (BASIC EMBODIMENT A)

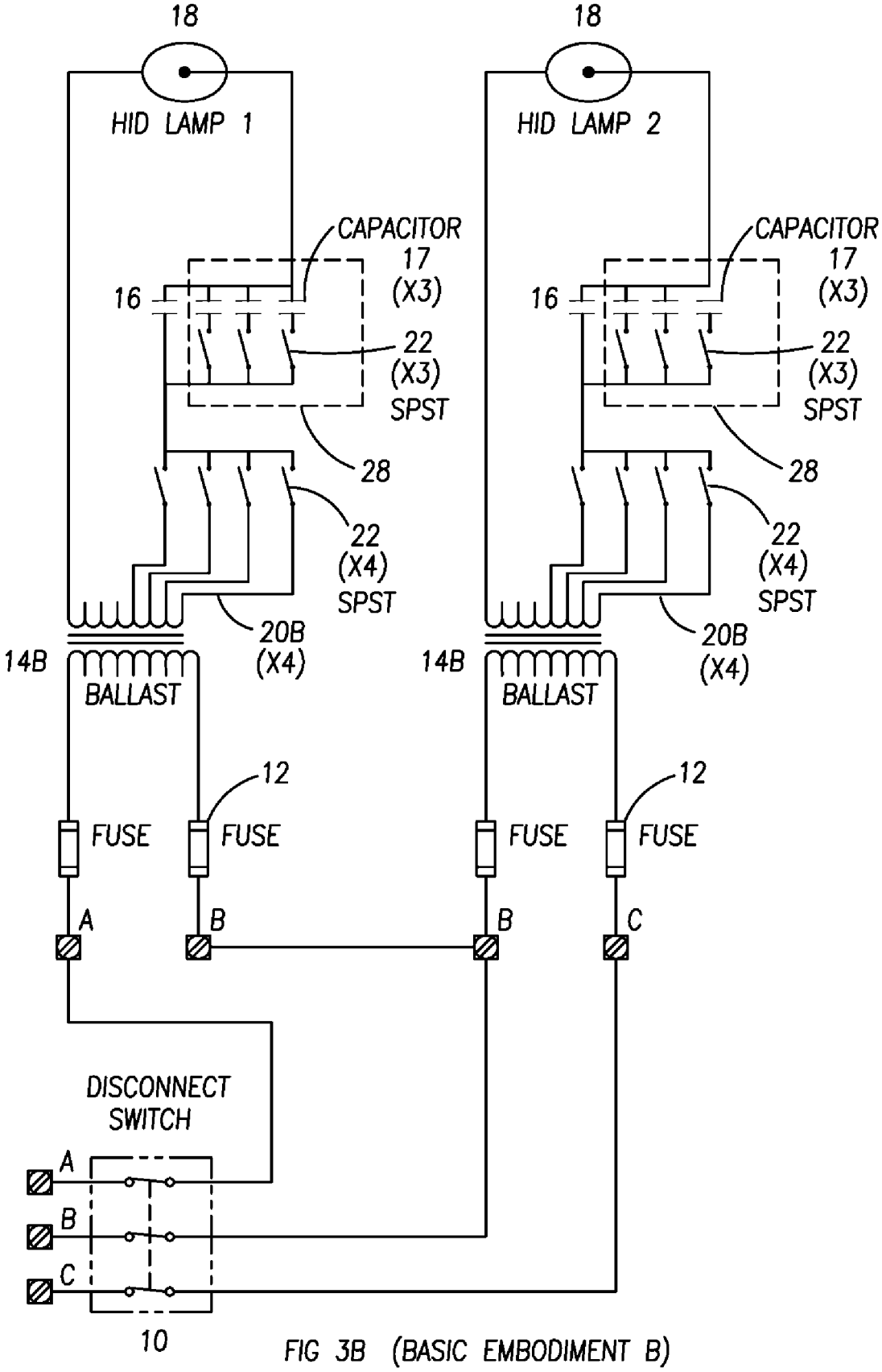
FIG 3B (BASIC EMBODIMENT B)

(ALTERNATIVE EMBODIMENT 1A)

(ALTERNATIVE EMBODIMENT 1B)

(ALTERNATIVE EMBODIMENT 1)

(ALTERNATIVE EMBODIMENT 2)

(ALTERNATIVE EMBODIMENT 2)

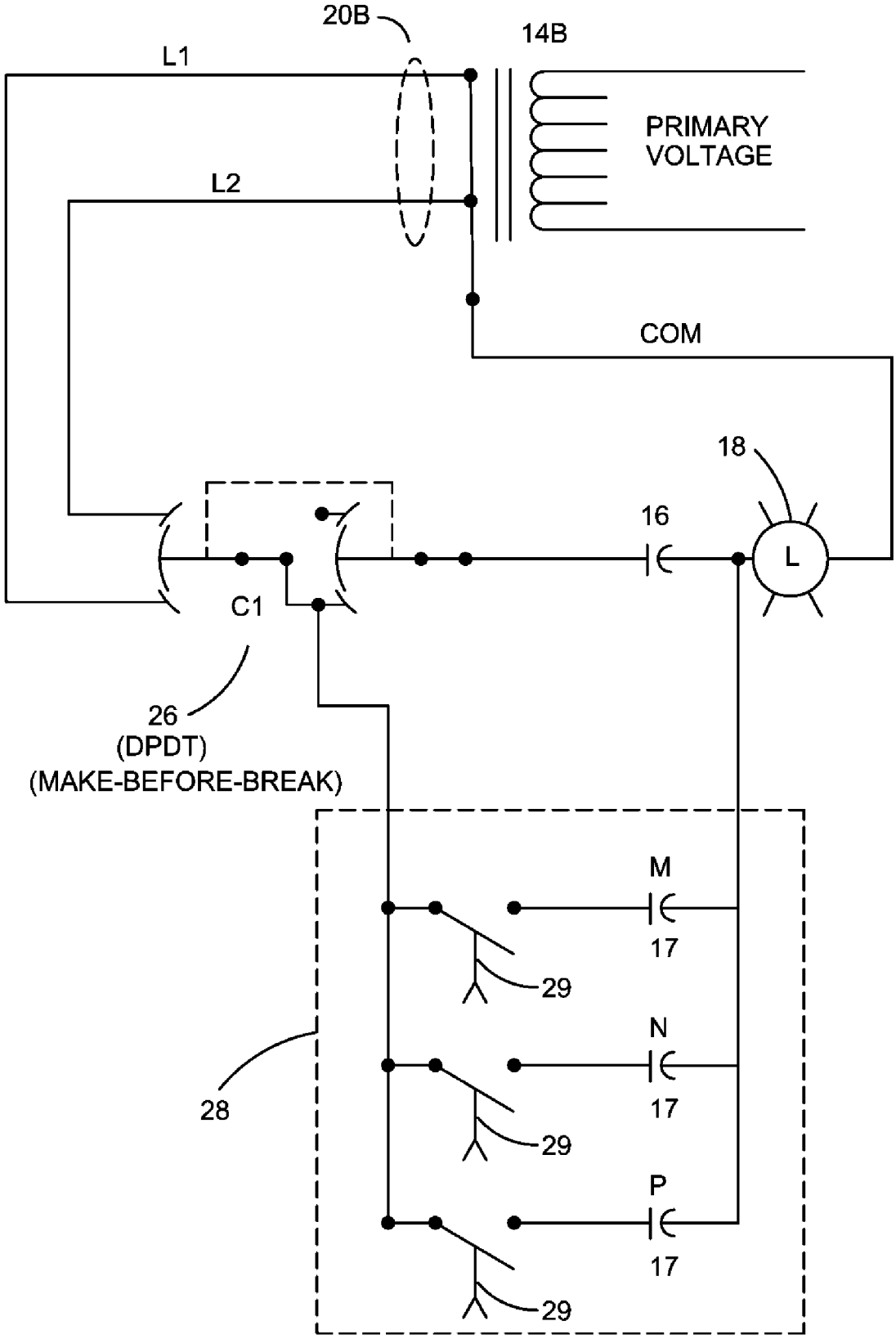
FIG 6A (ALTERNATIVE EMBODIMENT 3)

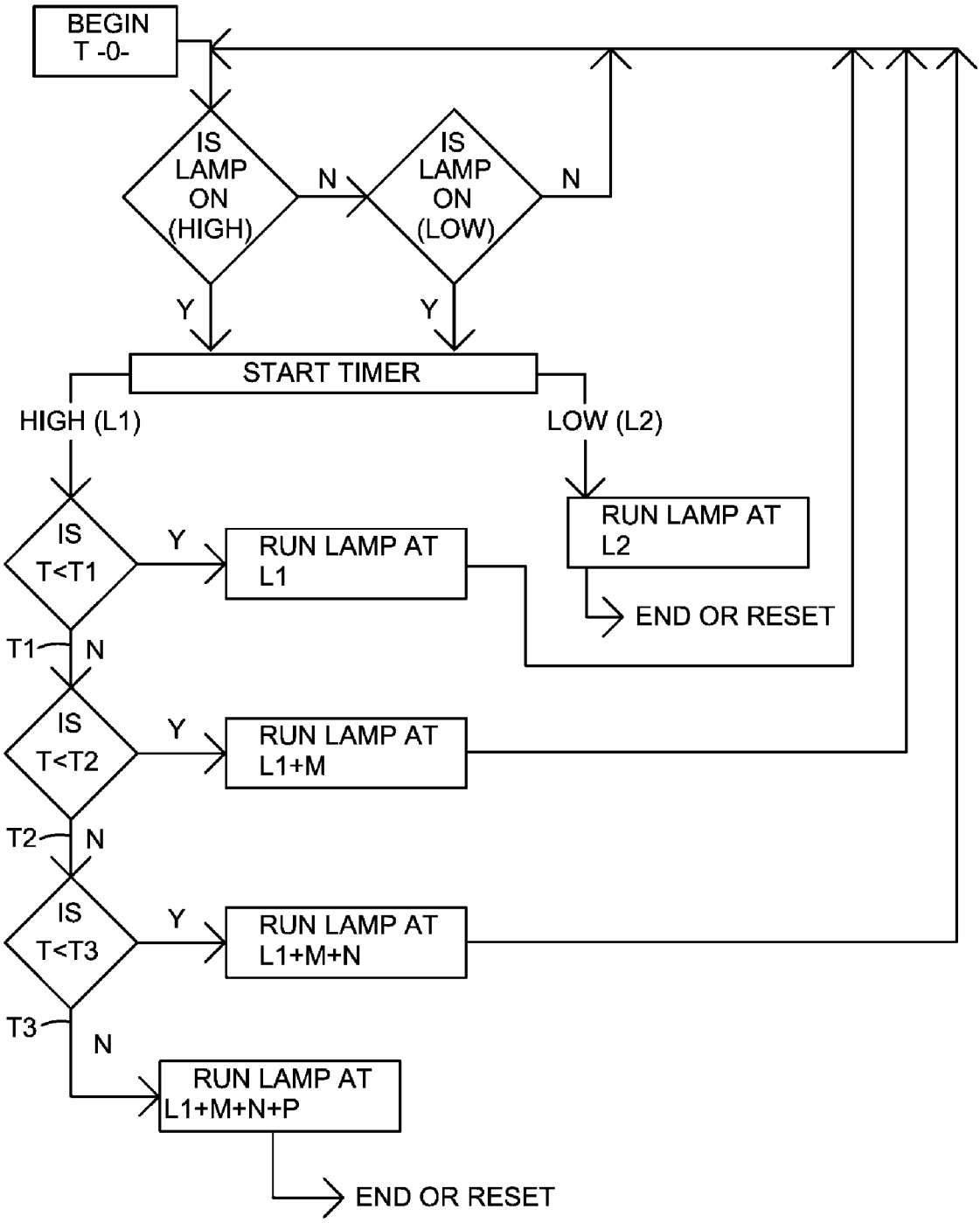
FIG 6B (ALTERNATIVE EMBODIMENT 3)

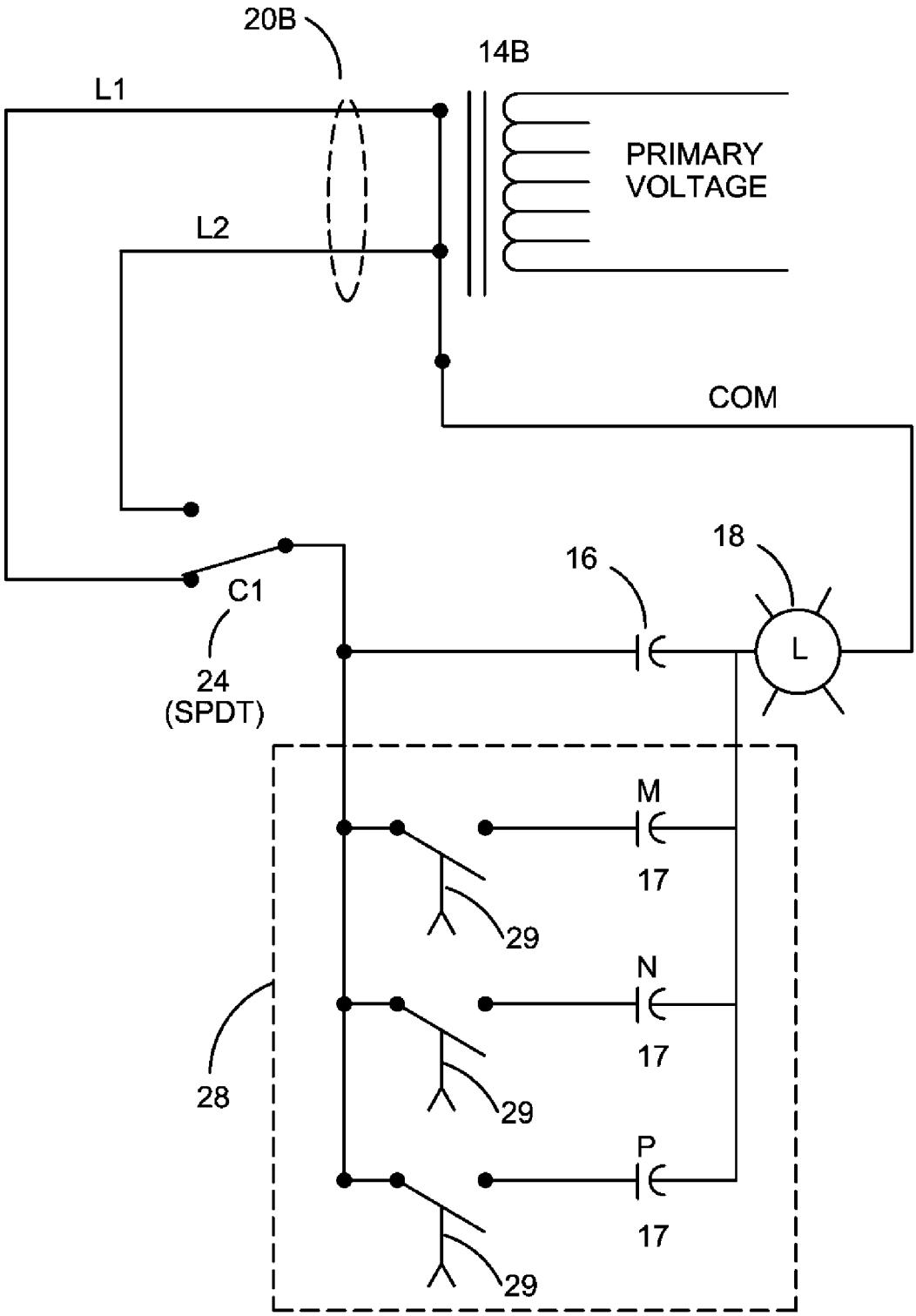
FIG 7A (ALTERNATIVE EMBODIMENT 4)

(ALTERNATIVE EMBODIMENT 4)

(ALTERNATIVE EMBODIMENT 4)

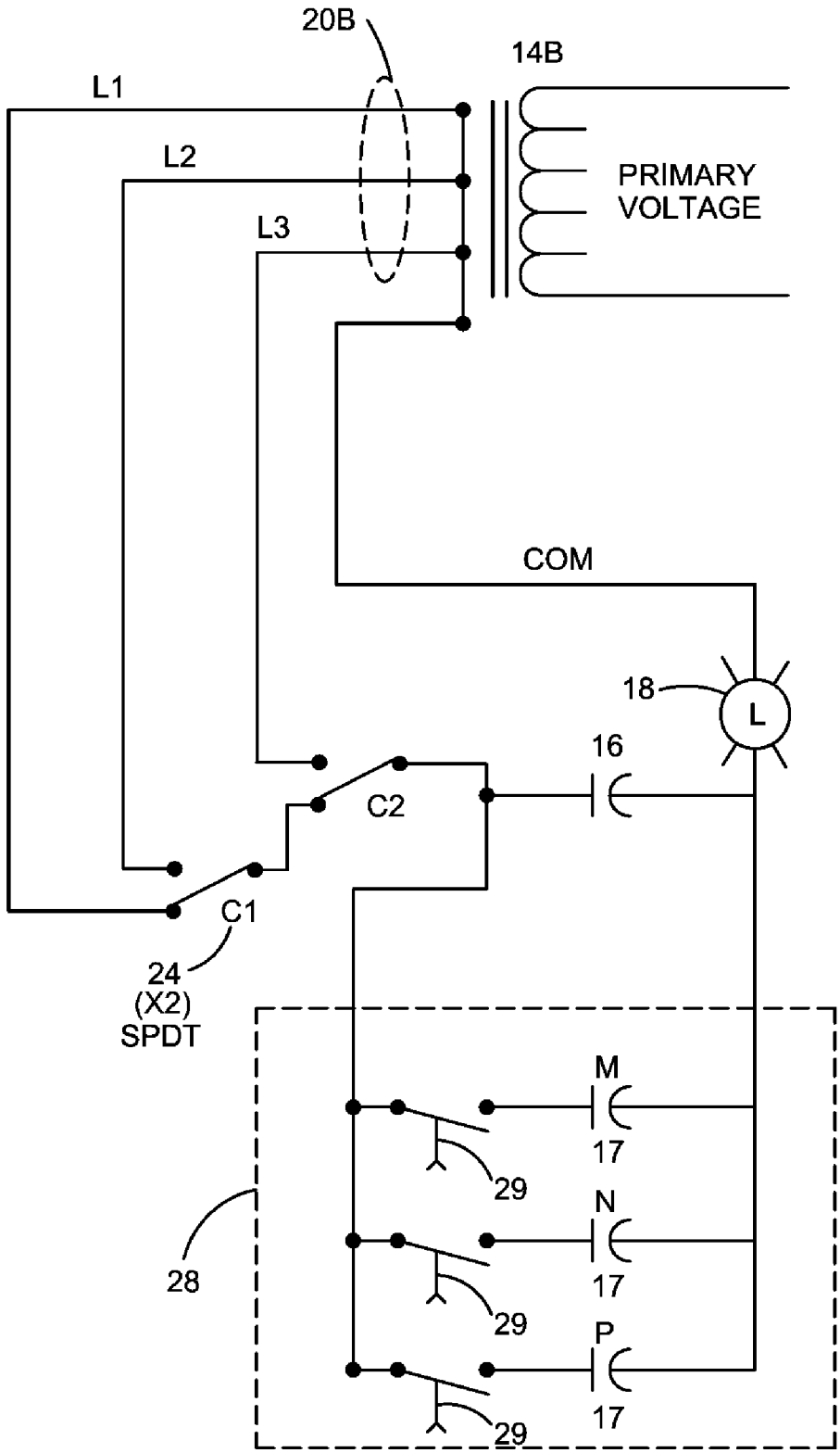
FIG 8A (ALTERNATIVE EMBODIMENT 5A)

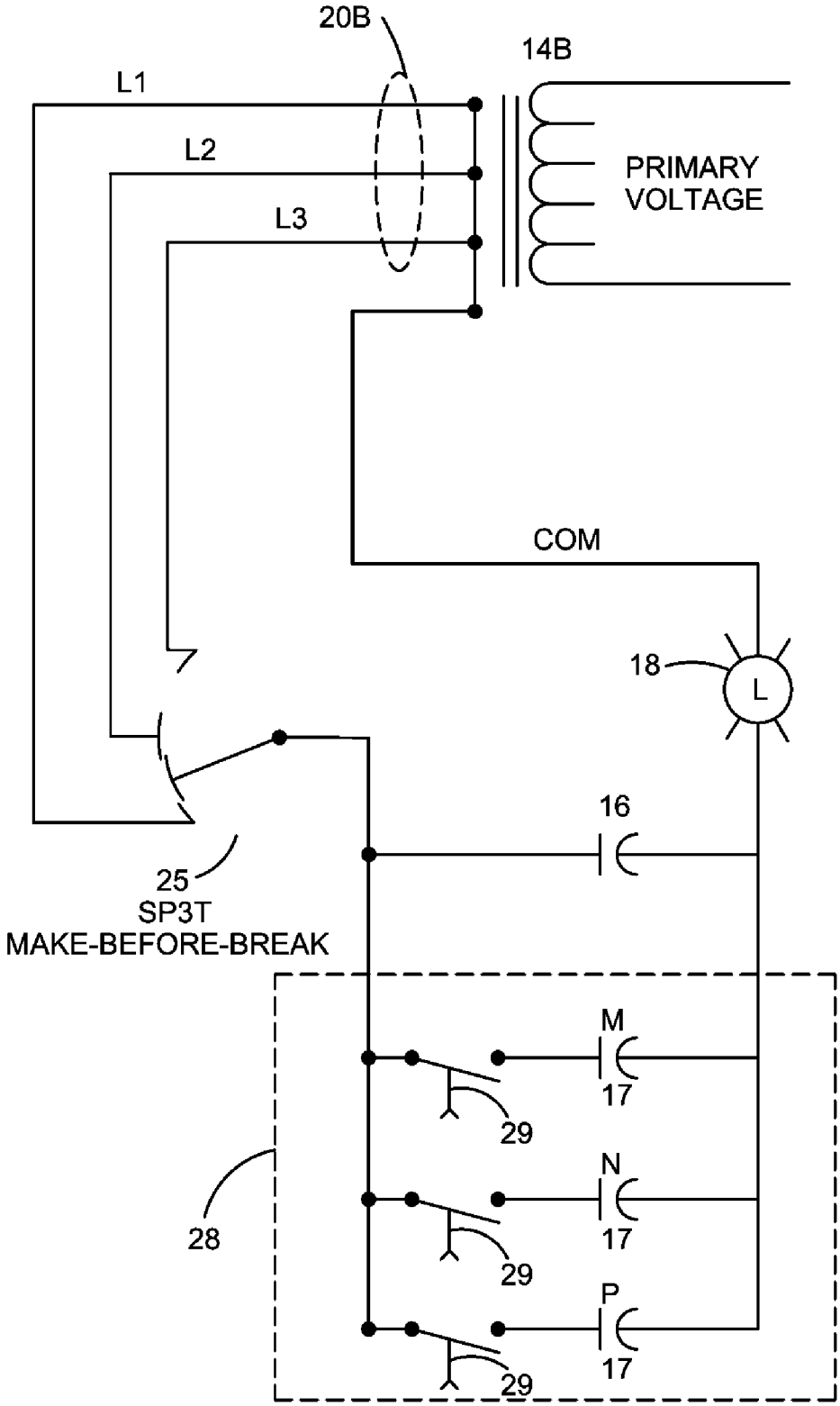
FIG 8B (ALTERNATIVE EMBODIMENT 5B)

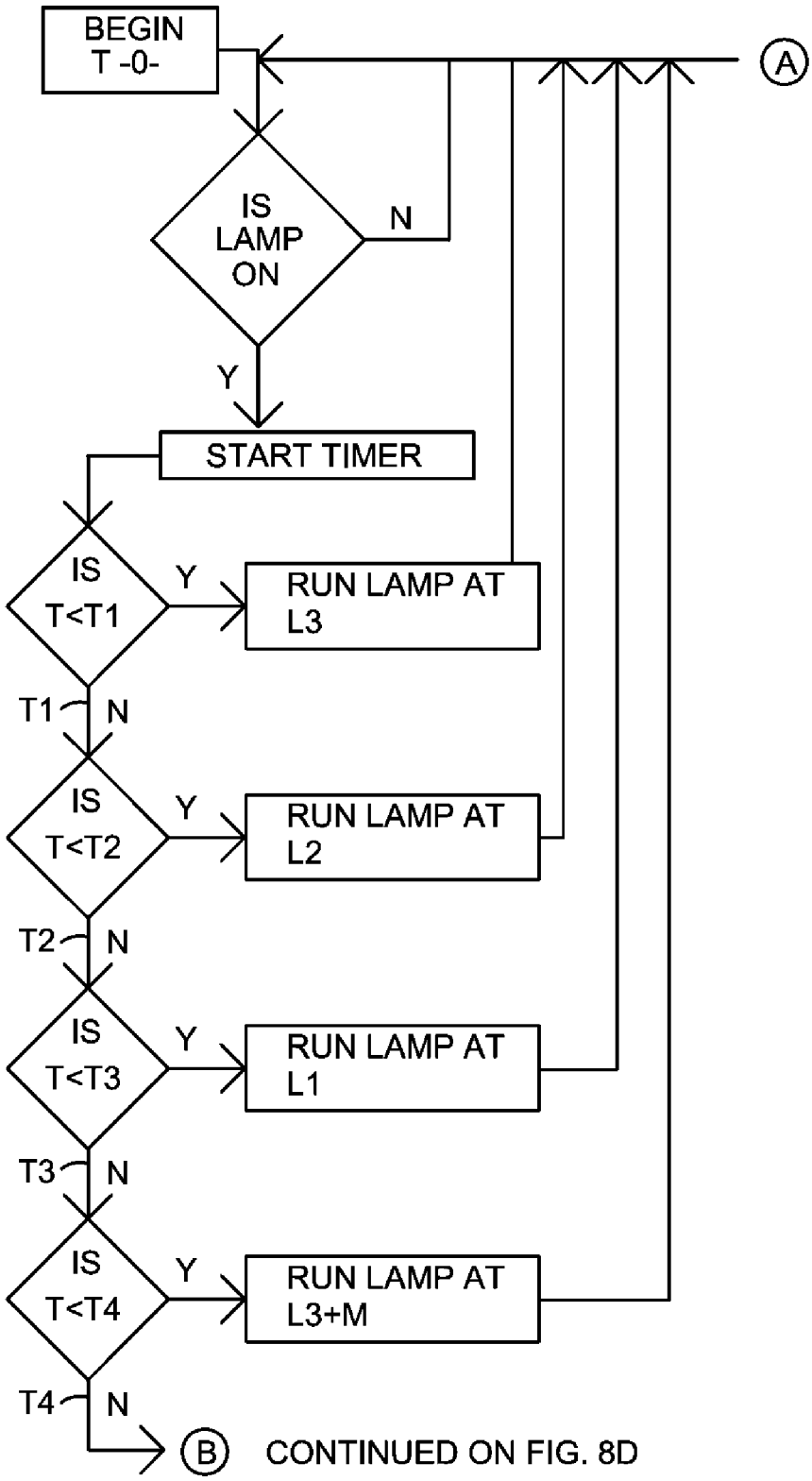
FIG 8C (ALTERNATIVE EMBODIMENT 5)

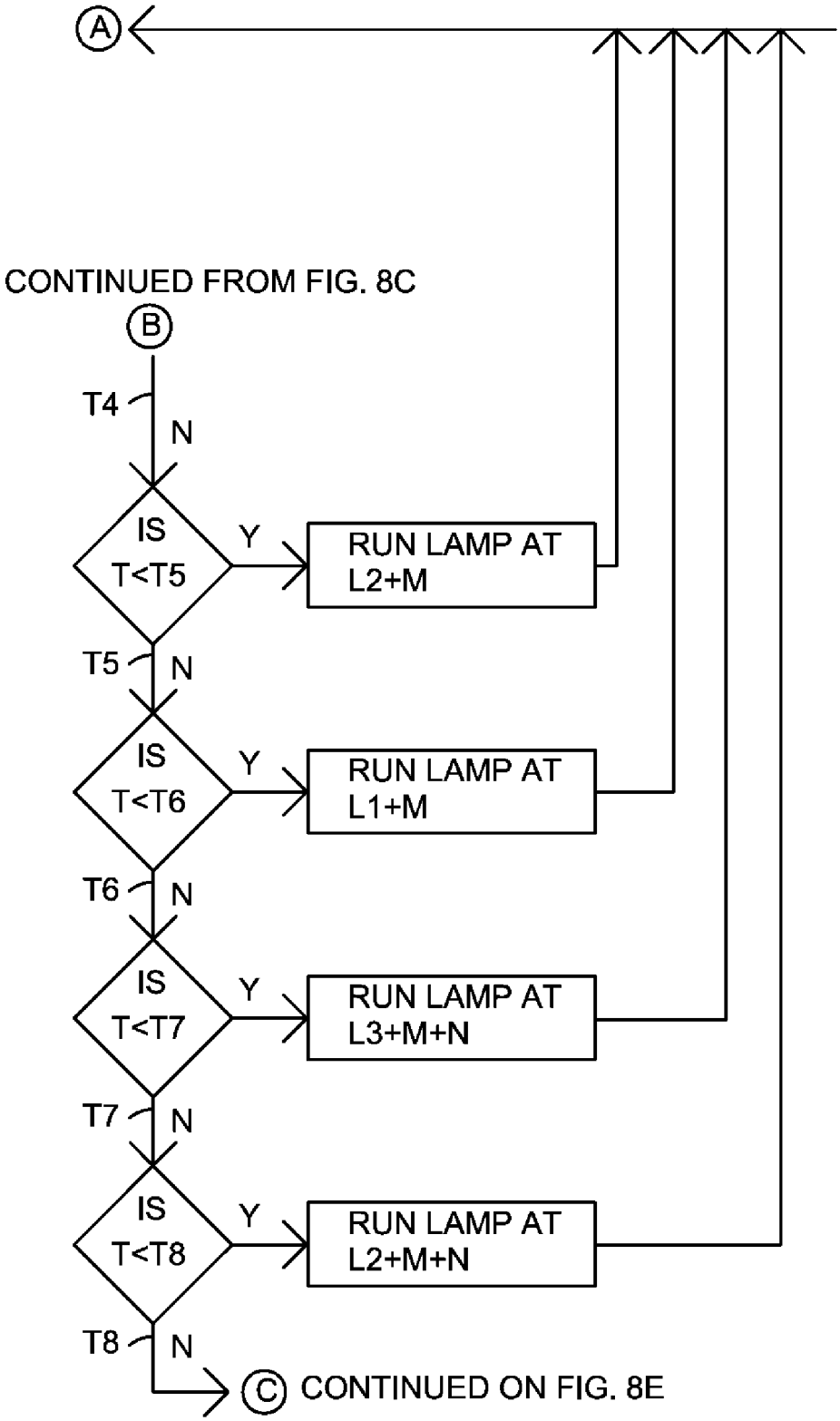
FIG 8D (ALTERNATIVE EMBODIMENT 5)

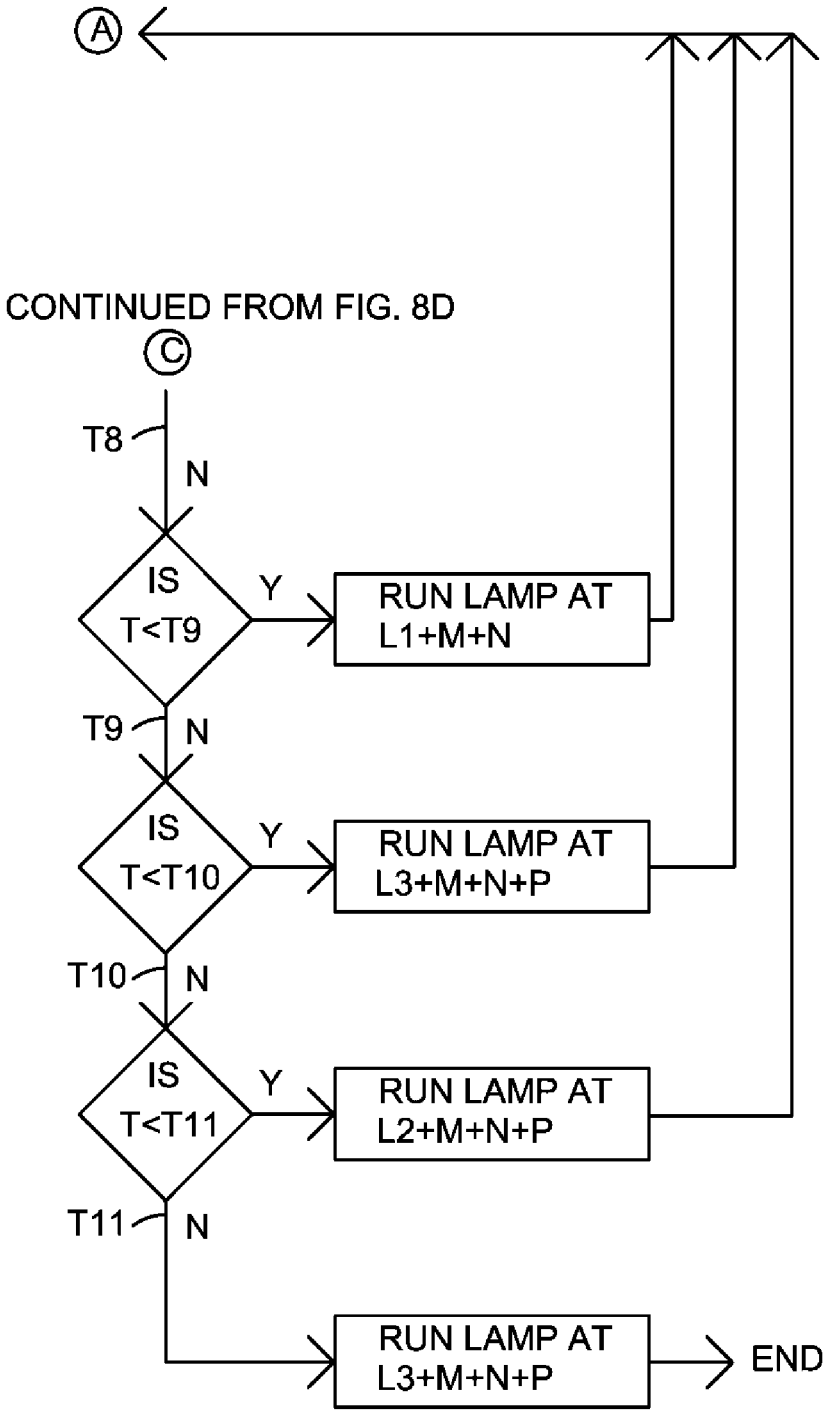
FIG 8E (ALTERNATIVE EMBODIMENT 5)

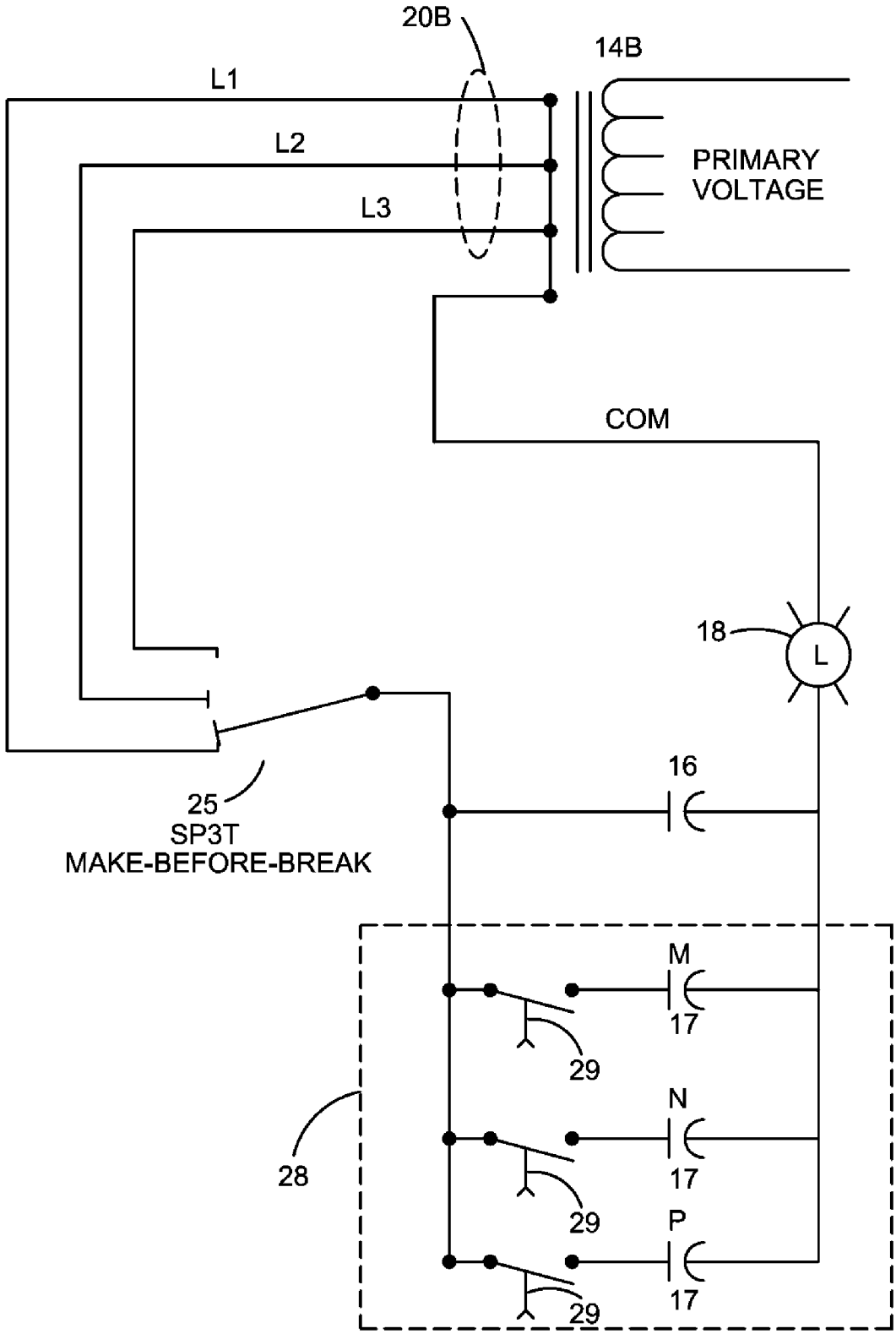
FIG 9A (ALTERNATIVE EMBODIMENT 6)

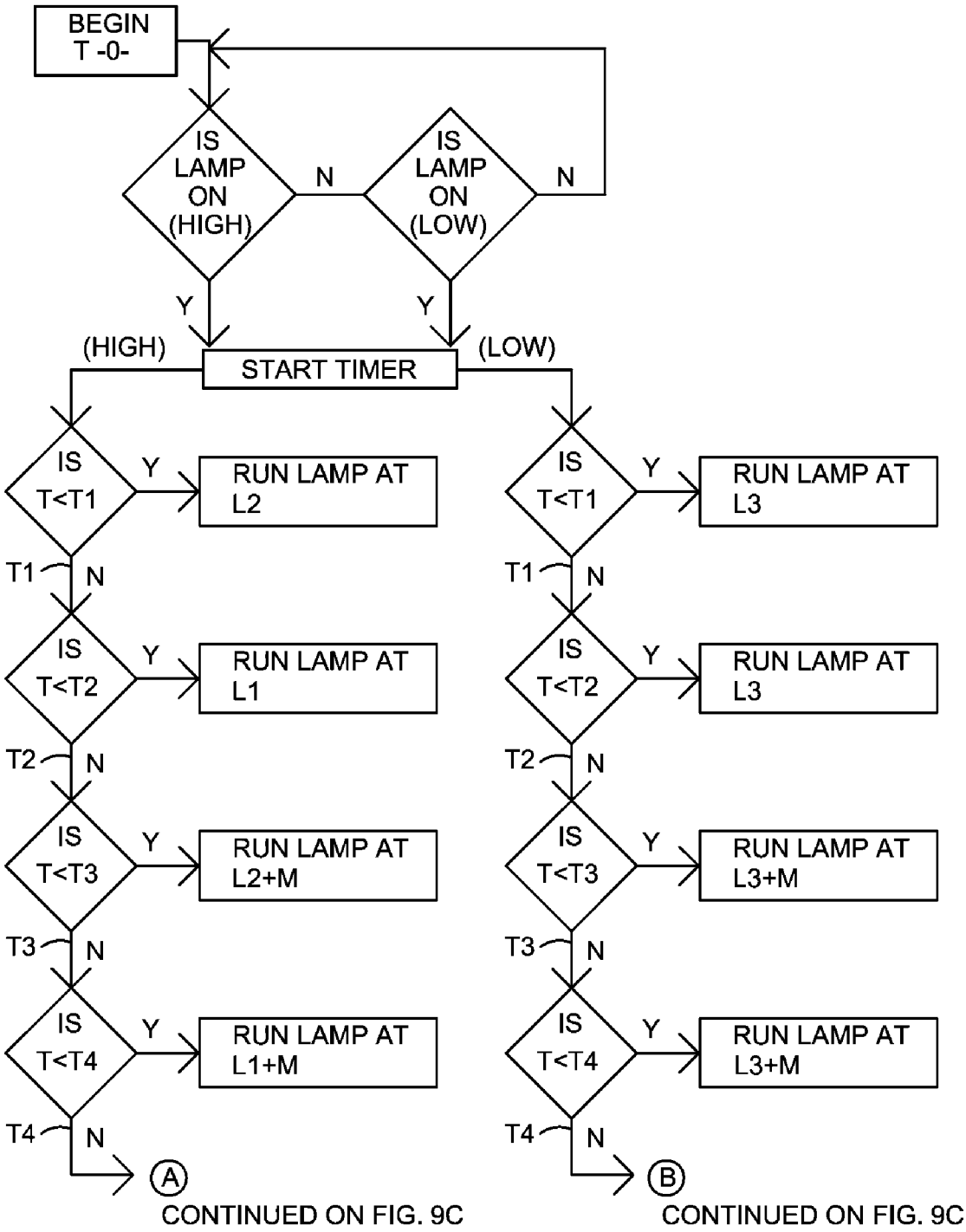
FIG 9B (ALTERNATIVE EMBODIMENT 6)

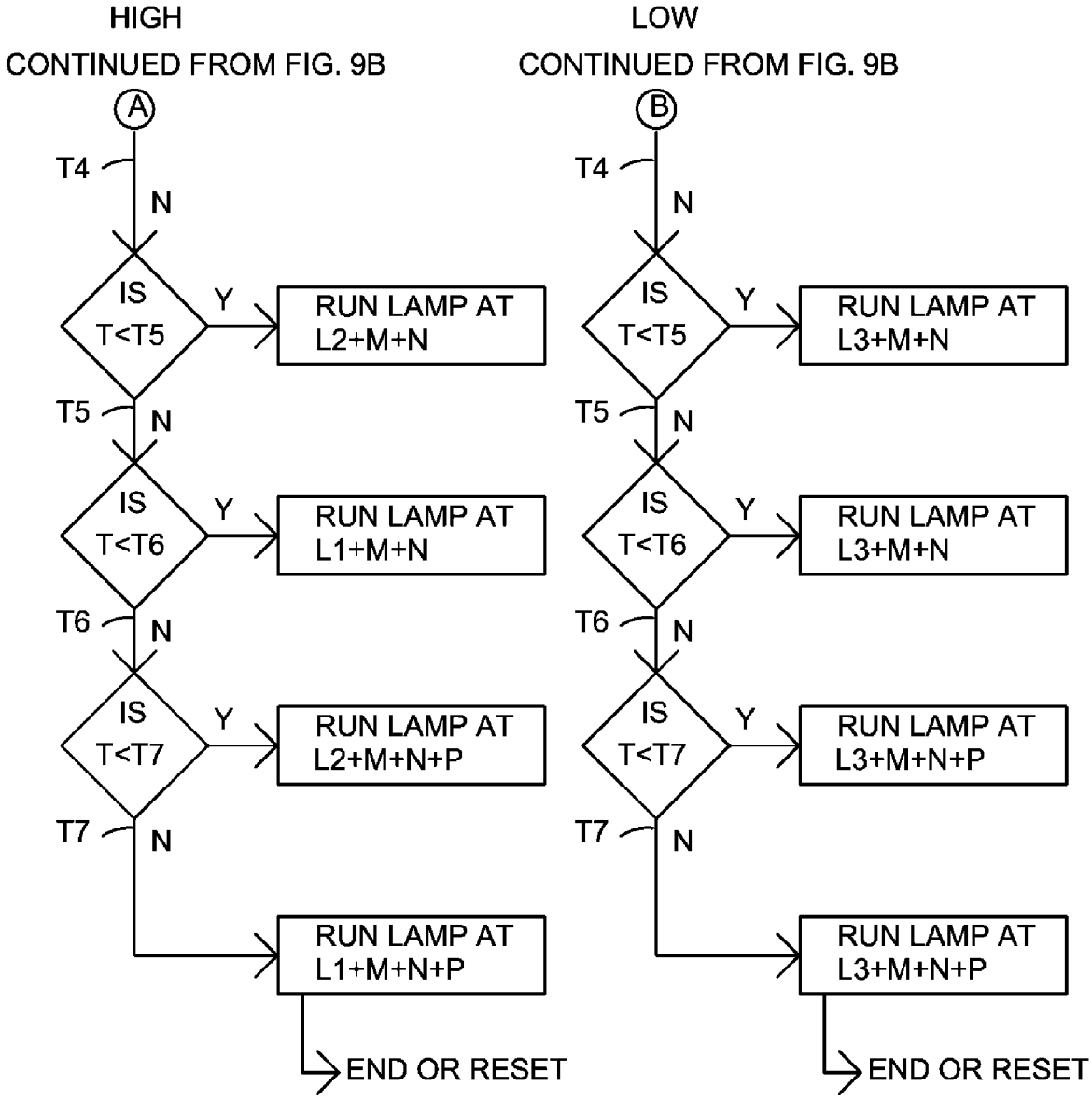
FIG 9C (ALTERNATIVE EMBODIMENT 6)

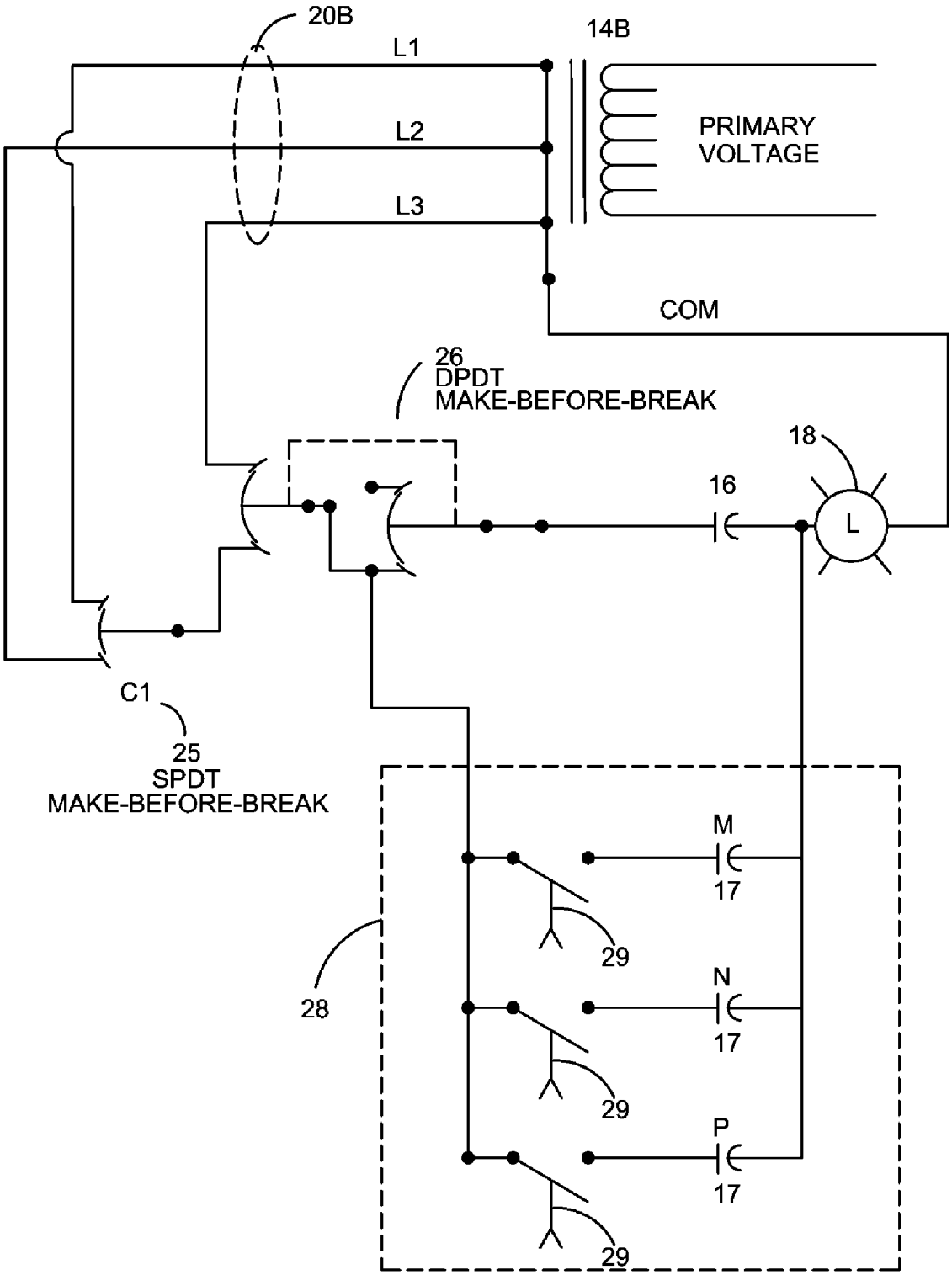
FIG 10A (ALTERNATIVE EMBODIMENT 7)

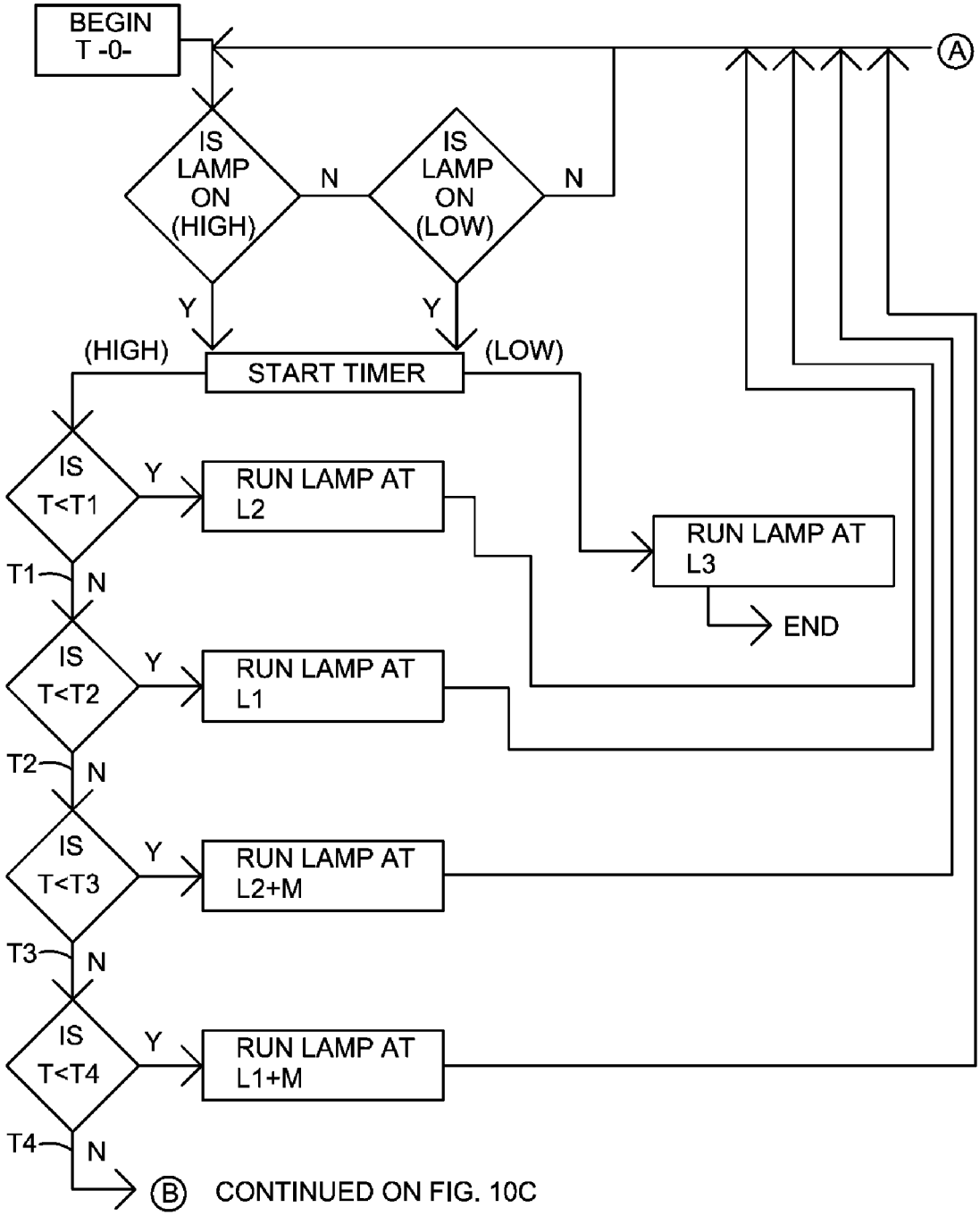
FIG 10B (ALTERNATIVE EMBODIMENT 7)

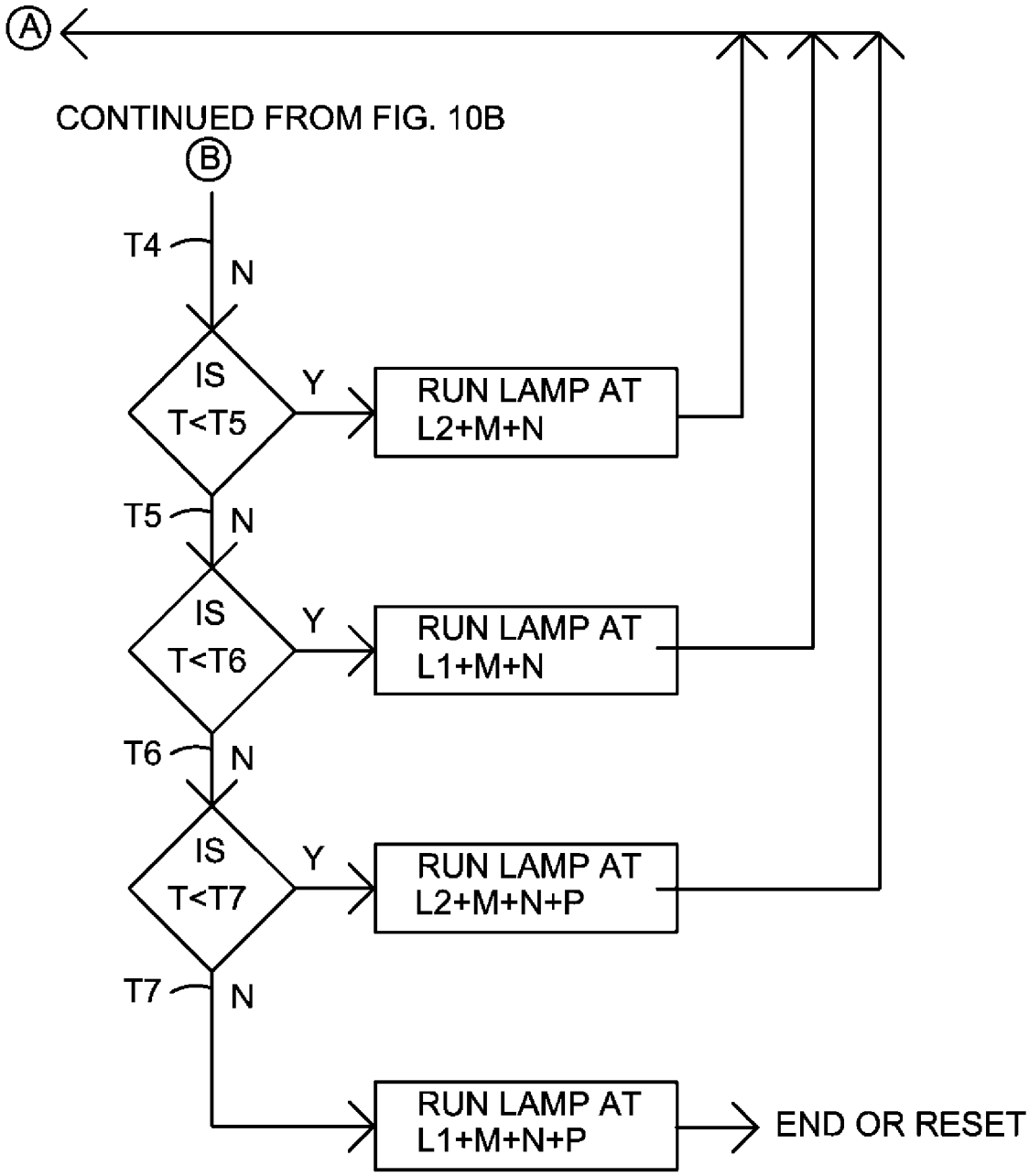
FIG 10C (ALTERNATIVE EMBODIMENT 7)

METHOD AND APPARATUS AND SYSTEM FOR ADJUSTING POWER TO HID LAMP TO CONTROL LEVEL OF LIGHT OUTPUT AND CONSERVE ENERGY (BALLAST MULTI-TAP POWER OUTPUT)

CROSS REFERENCE TO RELATED APPLICATIONS

This application claims priority under 35 U.S.C. Section 119 of a provisional application U.S. Ser. No. 60/871,629 filed Dec. 22, 2006, herein incorporated by reference in its entirety.

BACKGROUND OF THE INVENTION

A. Field of the Invention

The present invention relates to HID light sources with relatively high power consumption. In particular, it relates to controlling the amount of power provided to an HID light source in order to adjust the quantity of light output and the amount of energy consumed.

B. Issues in the Present State of the Art

The above-mentioned HID light sources are relatively high power and consume considerable amounts of energy per hour. Energy conservation is important because many lighting systems, especially sports lighting systems, utilize a plurality of light sources (e.g. a plurality of poles each with a plurality of light fixtures or luminaries—see FIG. 1 for one pole of plural fixtures) that operate for many hours each year. One common method to conserve energy is to operate the lighting system at a lower light output during times when less illumination is deemed acceptable by the owners, participants, or by standards of play set forth by lighting organizations.

One such lighting organization in the United States is IESNA (Illuminating Engineering Society of North America). Using sports lighting as an example, IESNA Publication RP-6-01 provides minimum recommended illumination levels based on the type of sport, the players' skill level, and/or the number of spectators. However, many lighting systems are used for multiple purposes which may have different lighting needs, e.g. a soccer field that is used for practice but also used for tournaments with spectators. A lighting system like this application would need to be designed for the highest level of illumination needed to allow for tournament play based on the skill level of the players and the number of spectators. However, this higher level of illumination is generally only needed for tournament play, which is usually considerably less overall time than for practice. Lighting for practice could be operated at a lower level of illumination per the IESNA guidelines, thus saving energy.

One method of adjusting the amount of light provided to a target with varying lighting needs, without dimming the lights, is to have switching circuits that only turn on a subset of the total set of lights or luminaries of the whole system for lower levels, and the entire set of the lights or luminaries of the whole system on for high levels. While this method is more efficient in regards to energy ratio to light output, additional lights are often required to ensure adequate beam distribution over the target area for all switching levels. This can add cost and energy usage to the system. Also, the lamps in different switching groups may accumulate uneven operating hours if some groups are used more frequently than others. This imbalance of operating hours can cause light level uniformity issues for some systems due to uneven lamp depreciation as well as different maintenance needs. In addition, switching mechanisms are required to turn on the appropriate lights for each illumination level which adds cost and complexity.

Methods do exist to control the amount of power provided to each lamp to reduce light output from the lights, but they generally require installation of additional circuitry components. Adjusting power to a lamp has a direct impact on the quantity of light output from the lamp. For each percent of power change, the light output percentage changes by approximately 1.5 percent. This relationship between power and HID light output is well known in the field of lighting.

The most common method of adjusting the power to a lamp for the purpose of reducing light output (sometimes referred to as dimming the lamp) is to change the amount of capacitance in the system that is related to the lamp. Capacitors in a HID lighting circuits restrict the amount of current the lamp is able to draw. Since the arc tube of an HID lamp is non-resistive, it will continue to draw power until it self-destructs if it is not regulated by a capacitor.

One known way to adjust capacitance for dimming purposes is to connect together multiple capacitors in parallel and control them by means of contactors or other methods of switching. At initial start up, the lamp is generally operated at full power for a period of time by switching in a commensurate cumulative capacitance from a plurality of capacitors to allow the lamp to stabilize. Then capacitance is removed from the circuit by opening the contacts on the contactor to switch out at least one capacitor, which results in significant less power to the lamp, thus both dimming the lamp and conserving energy. An example of this type of system is disclosed in U.S. Pat. No. 4,994,718 (incorporated by reference herein) (see also the MULTI-WATT™ product commercially available from Musco Lighting, Oskaloosa, Iowa 52577 USA ("Musco")). This method of starting in high level, power, or mode and dropping to a lower mode is many times used because the wattage levels for dimming are below the threshold at which the lamp is able start up and operate without first operating at near full wattage for the initial warm-up period of 15-20 minutes. For example, for a 1500 watt ("W") metal halide lamp, ANSI C78.43-2005 ("American National Standard for electric lamps—Single-Ended Metal Halide Lamps") specifies the lower lamp starting wattage threshold to be 1200 W. Testing of lamps utilized in Musco's sports lighting systems have indicated the ability to start and operate at slightly lower levels without any material impact to the lamp characteristics.

Using multiple capacitors to regulate the power to the lamp is somewhat limited due to practical matters. Additional space is needed for the additional components and associated equipment. Extra switching components are needed to control them. There must be a plurality of capacitors for each lamp. If there are a number of lamps per pole, the number of additional capacitors that must be installed and wired into the control circuitry and enclosure box 8 (see FIG. 1) for that pole are multiplied by that number of lamps. For this reason, most capacitor systems used for dimming are limited to one step-down in wattage. This may not be sufficient for some purposes.

Capacitors are also used to regulate the power to the lamp to hold the light output at a generally constant level. One method of capacitors used in this manner is disclosed in U.S. Published Patent Application 2005/0184681 A1 (incorporated by reference herein) (see also the SMART LAMP™ product commercially available from Musco). While this is an efficient method of controlling the power to the lamp, there is room for improvement in this area. For example, it would be advantageous to be able to expand the power range.

SUMMARY OF THE INVENTION

One aspect of the present invention is a non-electronic method of controlling the power provided to the lamp through use of multiple secondary taps off the secondary side of the HID ballast. This allows for a base capacitor to be used, along with the multiple secondary taps of the ballast, to vary the power to the lamp for purposes of providing constant light output, dimming capabilities, or to hold the power constant, or any combination of such.

One embodiment, which will be called the basic system, is similar to conventional HID electrical systems with ballast and capacitors, but the ballast contains multiple power taps on the secondary side that are capable of powering the lamp. By combining a single or multiple capacitor(s) with the multiple power taps off the ballast, the wattage provided to the lamp can be controlled and varied as needed to fit the application. Switches, such as electromechanical, electrical, or electronic contactors or relays, can be used to engage more or less capacitance or to increase or decrease the power from the ballast. This combination of capacitance and ballast secondary power is versatile in the number of outputs it can provide to the lamp to suit the desires or needs of the application or the designer.

An important feature of this embodiment is that the amount of space required for the additional components can be minimized. The ballast with multiple secondary power taps reduces the need for additional capacitors and does not consume any more space than a standard ballast, so less space is required. The only extra component needed is the contactor(s) or relay(s) to switch between taps and/or switch capacitance in or out. Expanding the power capabilities, while maintaining the same space requirements, is a significant improvement, as can be appreciated by those skilled in the art.

BRIEF DESCRIPTION OF THE DRAWINGS

FIG. 3A is electrical diagram of an HID lighting circuit according to one embodiment of multiple switchable taps on the secondary side of the ballast of the present invention using the Basic System Embodiment with a single capacitor source.

FIG. 3B is electrical diagram of an HID lighting circuit of this invention using the Basic System Embodiment (similar to FIG. 3A) but also with multiple switch-in-or-out capacitance sources.

FIG. 6A is an electrical diagram of an HID lighting circuit for an alternative embodiment 3 to provide high and low operating modes with constant wattage in low mode and constant light output in high mode using multiple ballast power taps and capacitance increases for the high mode.

FIG. 6B is a flow chart for embodiment 3 to provide high and low operating modes with constant wattage in low mode and constant light output in high mode.

FIG. 7A is an electrical diagram of an HID lighting circuit for an alternative embodiment 4 to provide constant light output with finer adjustment increments using combination of ballast power taps and capacitance increases.

FIG. 8A is an electrical diagram of an HID lighting circuit for an alternative embodiment 5 to provide constant light output with even finer adjustment increments using combination of ballast power taps and capacitance increases.

FIG. 8B is an alternate construction of embodiment 5 using single pole/double throw switches to control the ballast power tap and avoid lamp power interruption.

FIGS. 8C, 8D and 8E is a flow chart for embodiment, system and method 5 to provide constant light output with finer adjustment increments.

FIG. 9A is an electrical diagram of a HID lighting circuit for an alternative embodiment 6 to provide high and low operating modes with constant light output in both modes and fine adjustment increments in the high mode.

FIGS. 9B and 9C is a flow chart for embodiment, system and method 6 to provide high and low operating modes with constant light output in both modes and fine adjustment increments in the high mode.

FIG. 10A is an electrical diagram of an HID lighting circuit for an alternative embodiment 7 to provide high and low operating modes with constant wattage in low mode and constant light output in the high mode with fine adjustment increments.

FIGS. 10B and 10C is flow chart for embodiment, system and method 7 to provide high and low operating modes with constant wattage in low mode and constant light output in the high mode with fine adjustment increments.

DETAILED DESCRIPTION OF EXEMPLARY EMBODIMENTS OF THE INVENTION

A. Overview

Figure 1:
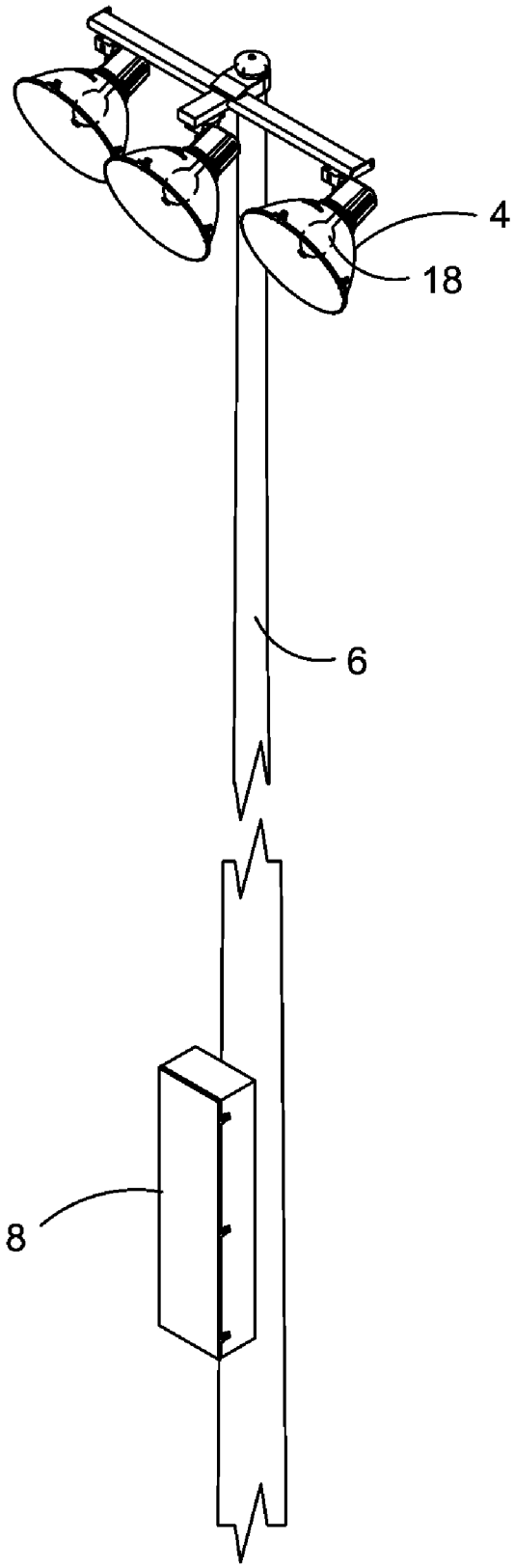
FIG 1 (PRIOR ART)
FIG. 1 is graphical representation of prior art lighting equipment including the mounting structure 6, electrical components enclosure 8, and lighting fixture 4 with light source or lamp 18.
Figure 2:
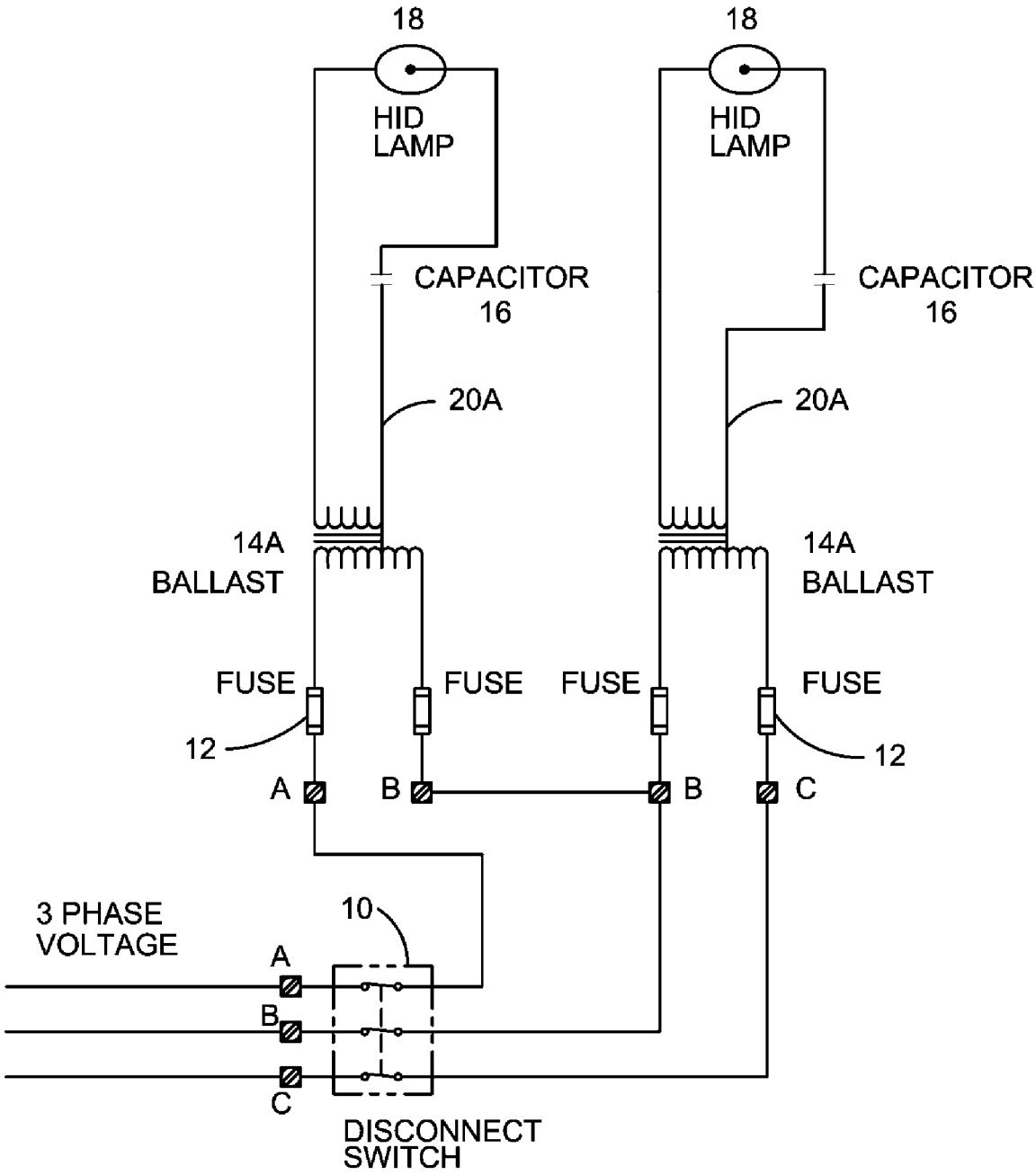
FIG 2 (PRIOR ART)
FIG. 2 is electrical diagram of a typical prior art HID lighting circuit for a conventional lighting system.

FIG. 2 shows the typical wiring diagram for an HID lamp electrical system with disconnect switch 10, fuse protection 12, ballast 14A, capacitor 16, and lamp 18 such as could be used with a sport lighting system such as illustrated in FIG. 1 (typically the system would have multiple poles each with multiple luminaries of fixtures 4, 18). FIG. 1 depicts a plurality of light fixtures (here three) on one pole, but it is to be understood that there could be more or less. Typically there would be at least three, and usually more. FIG. 2 illustrates how two lamp circuits would be connected to main electrical power, but as can be appreciated, for the three fixtures of FIG. 1 an additional lamp circuit would be added in parallel. For four or more fixtures, lamp circuits would be added in parallel in a similar fashion.

In conventional systems, HID lamps will suffer lumen depreciation with usage and produce less light output over time. One example is published by HID lamp manufacturer Venture Lighting International of Solon, Ohio, see line graph entitled "Range of Metal Halide Lumen Maintenance" from Venture Lighting International HID System Sourcebook, 2000 edition, p. 143, (incorporated by reference herein). Lamp lumen depreciation is well known to those in the art. To compensate for this depreciation in light output over time, the power provided to the lamp can be gradually increased over time to hold the light output at the nominal level. By starting new lamps at a lower wattage level and increasing the wattage over time to compensate for lamp depreciation, the light output over the life of the lamp can be held constant or at least nearly constant (i.e. "constant light"). One such known method is described in detail in Published Patent Application US2005/0184681 A1.

The present invention differs from the approach of Published Patent Application US2005/0184681 A1. A variety of embodiments according to the present invention can be adapted to most, if not all, types of HID lighting systems. One example of such a system could use the basic components shown in FIGS. 1 and 2 with fixture mounting structure and pole 6 to elevate the fixtures, electrical enclosure 8 to house electrical components, light fixtures or luminaries 4 each with light source or HID lamp 18 as shown in FIG. 1, and the lamp circuitry of FIG. 2. The embodiments of the present invention allow the amount of wattage provided to the HID source 18 to be controlled for purposes of, inter alia, (a) holding the energy consumption at constant or nearly constant level, (b) holding the light output nearly constant, (c) providing dimming capabilities to conserve energy, or (d) any one or any combination of these functions. By "nearly" it is meant that light output is normally between +/−10% of a value; but preferably even closer to the value. The invention has a basic embodiment that can assume many variations to suit specific needs or desires, as will be described immediately below, but also can take alternative embodiments from that basic embodiment, some of which will be described thereafter.

B. Basic Embodiments (FIGS. 3A and 3B)

A basic embodiment is similar to a conventional high intensity discharge (HID) lamp electrical system shown in FIG. 2 that includes a ballast 14A with single power tap 20A, capacitor 16, and lamp 18. Details regarding one conventional HID lamp ballast can be seen at www.venturelighting-.com/techcenter/ballasttechintro.html. In this basic embodiment of FIG. 3A, the ballast 14B, contains multiple power taps 20B off the secondary coil of the ballast 14B. A single capacitor 16, FIG. 3A, or capacitors 16 with Smart Lamp™ circuit 28 (available from Musco and see US2005/0184681 A1), can be used as shown in FIG. 3B. To operate each lamp 18 at different wattage levels, four single-pole, single-throw ("SPST") switches 22 can be used to determine what power tap 20B is used in combination with capacitor 16 per FIG. 3A or with the capacitors of the Smart Lamp™ circuit 28 shown in FIG. 3B. The amount of wattage obtained from the secondary side of the ballast 14*b* can be controlled during the ballast manufacturing process by varying where the power tap 20B is pulled off the secondary windings. This is similar to how transformers are constructed. The wattages used to provide constant light output are similar to the wattage values defined in US2005/0184681 A1.

Ballast manufacturers can install some type of electrical interface to selected locations on the secondary winding. For example, the electrical interface could be wire leads soldered to spaced apart locations on the secondary winding. By known electrical rules, the different locations provide different voltage or power. The interface (e.g. wires or other electrical connectors) can have terminations that could be electrically connected into the circuitry of the exemplary embodiment(s). If a wire lead is not used, it can be simply capped off. These techniques are similar to electrical transformer manufacturing.

There are many different control methods currently available to switch in/out the ballast power and capacitance. One such method is Musco's Smart Lamp™ system that, in one embodiment, uses an electromechanical timer with switch contacts. Another method could be Musco's Control-Link™ system with remote communication system. These methods are disclosed in U.S. published application 2005/0184681 A1 and in U.S. Pat. No. 6,681,100 (incorporated by reference herein) respectively. In yet another control method, a photocell light intensity sensor feedback with threshold limits could be used to signal when to vary the light output if the desire is to have near constant light levels.

The following exemplary embodiments, methods and systems describe in detail some alternatives to or variations of this basic embodiment. Electrical circuit diagrams and flow charts are used to help describe each embodiment. Similar to the Smart Lamp™ of US2005/0184681 A1, "ROW" is used to indicate the lamp manufacturer's "rated operating wattage". In the following embodiments, the "L" variable is used to indicate the wattage provided by the ballast. If multiple power tap wattages are provided, then each wattage output is identified by L1, L2, L3 and so on (with L1 indicating highest wattage—and sometimes equal to ROW). For changes in operating wattage due to adjusting capacitance, variables "M, N and P" are used (M, N, and P could be of a different capacitance value to capacitor 16 or to each other; M, N, and P could be added to the lamp circuit individually or cumulatively), similar to as shown in the referenced US2005/0184681 A1. As indicated in US2005/0184681 A1, addition of capacitance in the manner of SMART LAMP™ is cumulative and each additional capacitance raises the operating wattage of the lamp circuit. This allows a sequential step-up of operating wattage over time. It can therefore be seen how the basic embodiment and its variations achieve one or more of the stated objects of the invention.

C. Exemplary Alternative Embodiment, Method and System 1 (FIGS. 4A-C)

To provide additional understanding of the invention, alternative exemplary embodiments to the basic embodiments will now be described. They will be called "Embodiment 1", "Embodiment 2", etc. to distinguish them from the prior-described "basic embodiments".

1. Embodiment 1 Generally

Figure 4A:
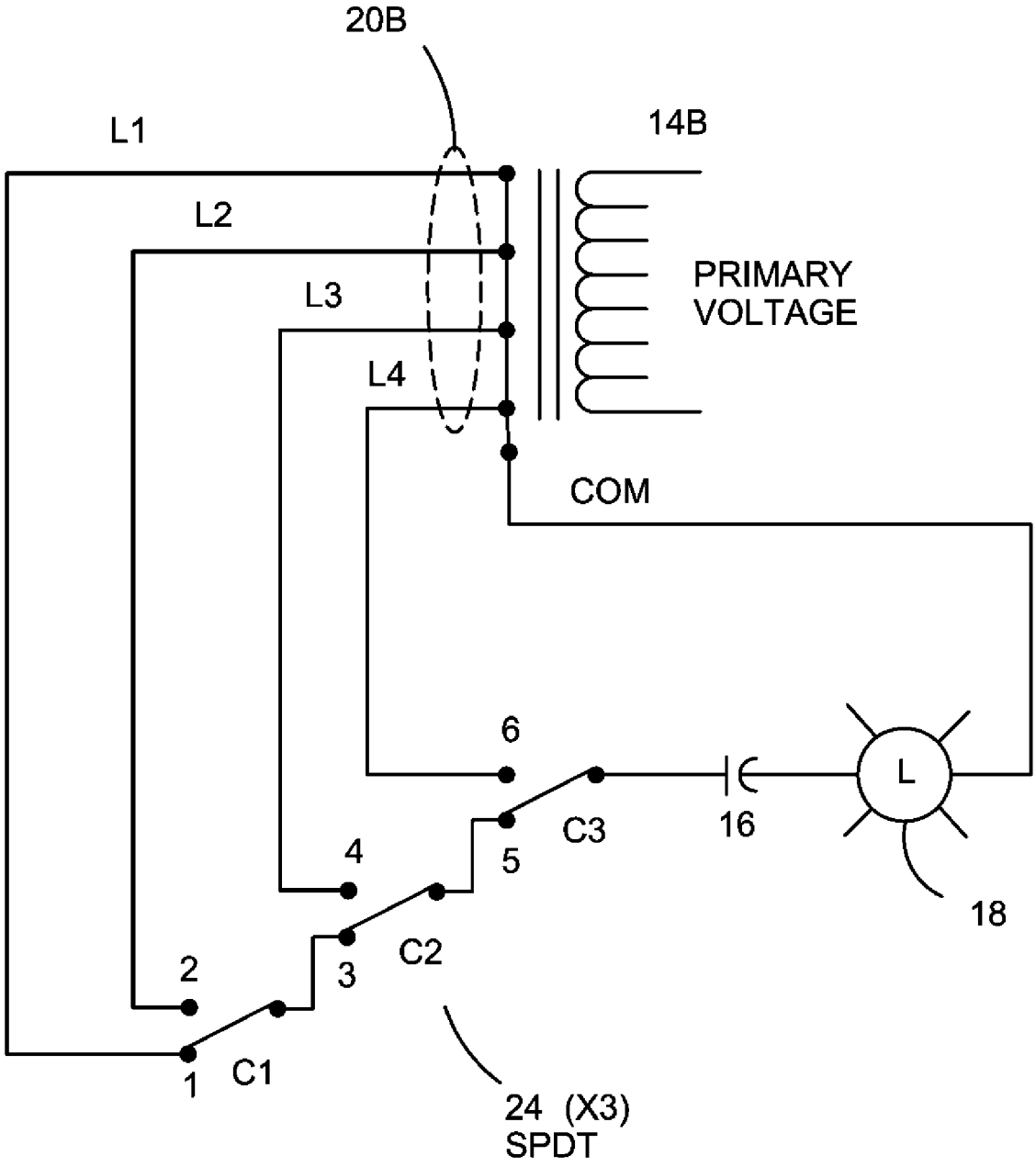
FIG. 4A is electrical diagram of an HID lighting circuit for a specific alternative embodiment 1 to provide constant light output using multiple ballast secondary power taps.
Figure 4B:
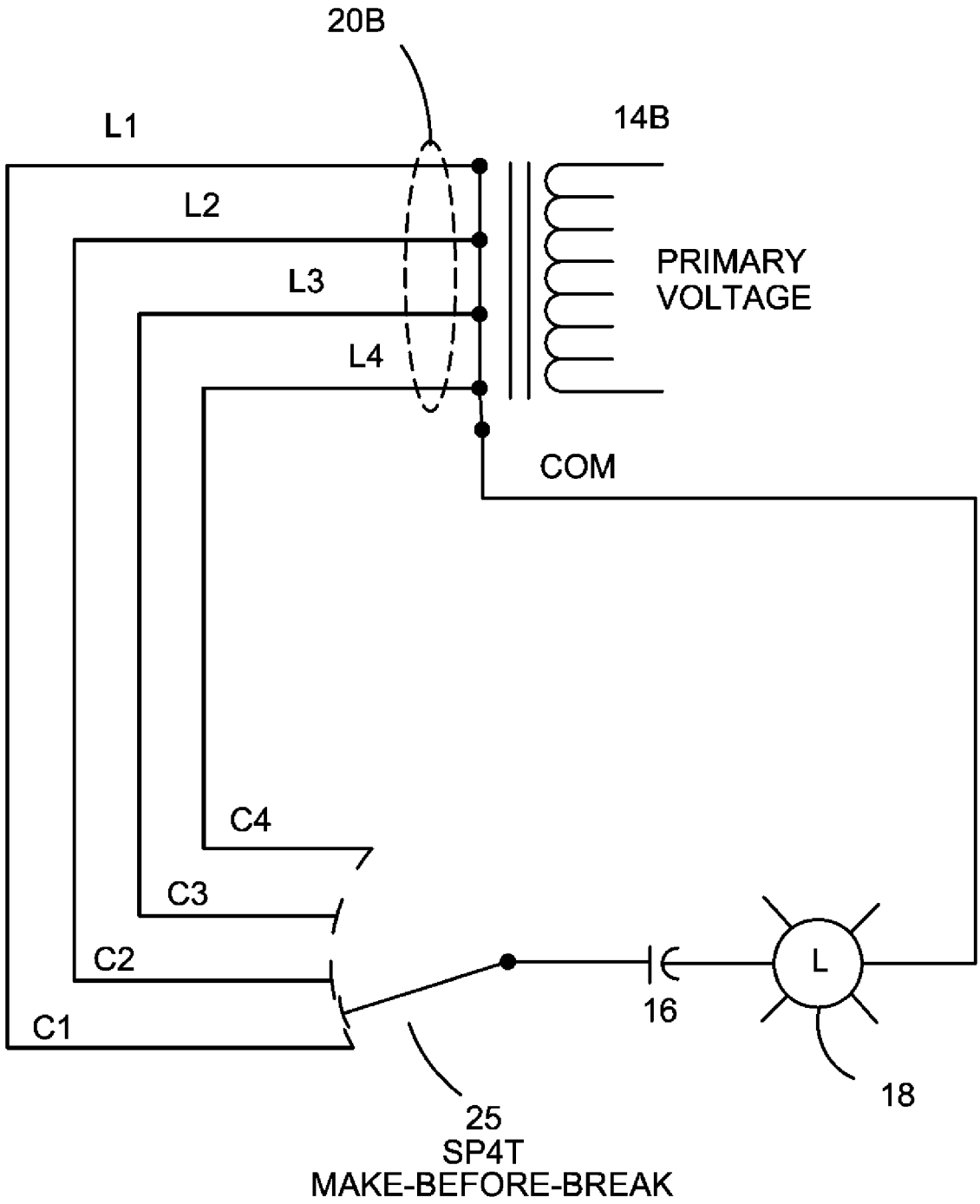
FIG. 4B is an alternate construction of embodiment 1 using single pole/double throw make-before-break switches to control the ballast power tap and avoid lamp power interruption.
Figure 4C:
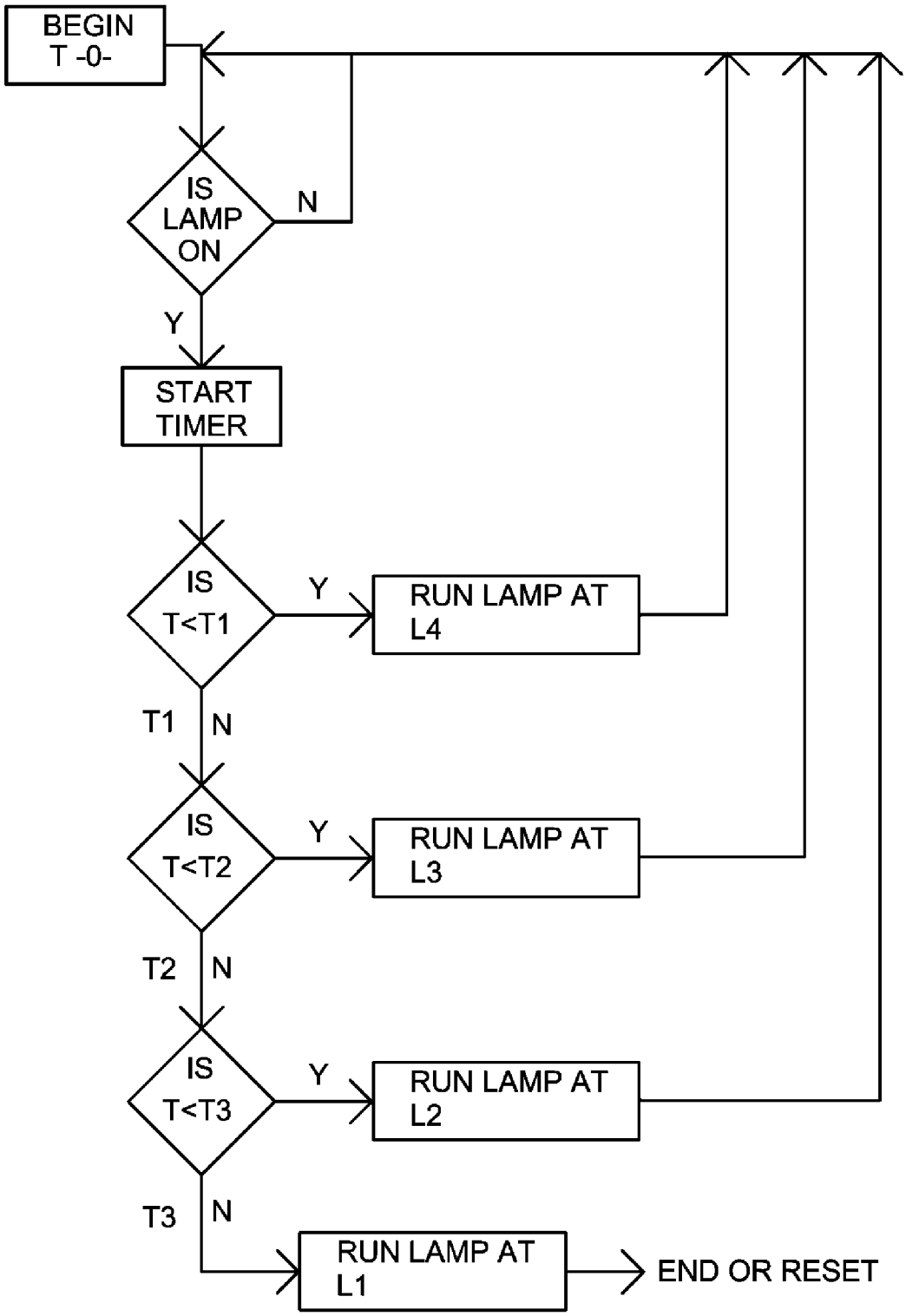
FIG. 4C is a flow chart for the method, apparatus and, system of embodiment 1 to provide constant light output using multiple ballast secondary power taps.

The first exemplary alternative embodiment, FIG. 4A, utilizes ballast 14B with multiple secondary power taps 20B, represented by output wattage variables L1, L2, L3 and L4, all controlled by three single poles/double throw (SPDT) switches 24. Each switch 24 in FIG. 4A is also indicated by "C", that is C1, C2, and C3, to indicate each is a separate contactor that can be controlled by an electrical signal. Here only three contactors C1, C2, and C3 are needed to select from the four taps L1, L2, L3, and L4 because of the different combinations of opening and closing of such contactors, as indicated in the table below:

| | To get L1 | To get L2 | To get L3 | To get L4 |
|---|---|---|---|---|
| Position of C1 | Point 1 | Point 2 | Point 1 or 2 | Point 1 or 2 |
| Position of C2 | Point 3 | Point 3 | Point 4 | Point 3 or 4 |
| Position of C3 | Point 5 | Point 5 | Point 5 | Point 6 |

The ballast power taps 20B are wired in series with single capacitor 16 to provide the correct operating wattage to the lamp 18. Only one ballast power tap 20B is used at any given time to power lamp 18. Lamp 18 is connected to capacitor 16 output and to the common (COM) connection off ballast 14*b*. However, if "break-before-make" SPDT switches 24 are used, the switch timing between ballast power taps L1-L4 must occur during startup, not while lamps 18 are operating. This requirement is to prevent the lamps 18 from extinguishing during switching because power would be momentarily lost from one power tap to another, e.g. L2 to L1. To switch during lamp operation, a "make-before-break" single pole/quadruple throw (SP4T) switch 25, FIG. 4B, can be used to ensure "make-before-break" connections (well-known in the art) so the lamp operation is not interrupted. Note that in FIG. 4B four contactors C1-C4 are needed to select between the four wattages L1-L4 because a single single-pole switch is used:

| | To get L1 | To get L2 | To get L3 | To get L4 |
|---|---|---|---|---|
| Status of C1 | Closed | Open | Open | Open |
| Status of C2 | Open | Closed | Open | Open |
| Status of C3 | Open | Open | Closed | Open |
| Status of C4 | Open | Open | Open | Closed |

The switches can be controlled by many of the same systems described in the U.S. Pat. No. 6,681,110, which include but are not limited to electrical timers to control switches 24 or 25 (or contactors or relays), remote communication to control switches 24 or 25 via Control-Link™ (a remote control system available from Musco—see U.S. Pat. No. 6,681,110) or similar control system, or photocell signal that controls the switches 24 or 25. These are just a few examples of methods to control the switches. Many other methods are possible and known or within the skill of those skilled in the art to implement.

2. System of Embodiment 1

A system utilizing embodiment 1 will provide constant light output with variable energy consumption. The initial stage of the system uses the ballast power taps 20B with the lowest wattage L4, with the capacitor 16 to provide the initial current or wattage to the lamp (in one embodiment L1 is sufficient to produce at least a minimum specified light output of lamp lumens from lamp 18 for adequate lighting of the sports field 4). As the lamp depreciates over time, the next higher wattage power tap L3 will replace the previous power tap L4 to maintain or restore a relatively constant output of the lamp lumens. This event will repeat throughout the life of the lamp for each additional power tap L2 & L1 available to hold the light output relatively constant.

The end of lamp life is generally considered to be when the lamp is no longer efficient to operate. Upon lamp replacement, the system is reset to the lowest wattage and the cycle starts over. In this embodiment, the light is held at nominal level while the energy level gradually increases with each power adjustment. However, the total energy consumption throughout the life of the lamp is still lower than the conventional operation method of full wattage for entire life of lamp if, e.g., L4, L3, and L2 are lower than the rated operating wattage (ROW) of lamp 18.

Actuation of the components discussed herein can be controlled in a number of ways. Several are mentioned in US2005/0184681 A1.

3. Method of Embodiment 1

Referring to the flow chart for system one, FIG. 4C, the method of operation will be discussed. During the initial startup of the system the time is set to zero, as represented by T0. When the lamp is powered on, the timer cumulates time (it basically keeps track of total operating time for the lamp). Based on the lumen depreciation curve of the light source (usually available from the lamp manufacturer), the timing function is configured to adjust the wattage to the lamp at key intervals, i.e. time thresholds. These can be selected by the designer. They could be at equally spaced intervals or otherwise. There could be more or less than the three time thresholds illustrated in this embodiment. It could be that capacitance increases occur more frequently earlier in operating life of the lamp, e.g., if its lumen depreciation is more rapid earlier.

The time thresholds are set for the system and are represented in this example by T1, T2 and T3. The time threshold is the amount of operating time that passes before an adjustment is made in the lamp operating conditions. As the lamps operate, the cumulative time is monitored by the timing function. When time, represented by "T", is between T0 and T1, the lamp operating wattage equals L4. As time increases, T will equal or exceed T1, thereby adjusting the lamp operating wattage to L3. With additional operation, time will equal or exceed T2, thereby adjusting the lamp operating wattage to L2. When time "T" exceeds T3, the final lamp operating wattage is L1. The lamp will continue to operate at wattage L1 regardless of time, until the lamps are replaced and the system time function is reset to T0; after which the process will repeat.

As mentioned, to save energy over the life of lamp 18, L4 can be selected to be under ROW of lamp 18, as can be L3 and/or L2, and even L1. However, if relatively constant light output is desired over the entire normal life of lamp 18, it may be that L1 and/or L2 and/or L3 may have to be close to or even over ROW. In such cases, there may not be a substantial energy savings over the entire life of the lamp 18, and in some cases, there may be no energy savings. However, there usually would be some energy savings at the front end of operating life and the benefit of relatively constant light output over the life of the light source is achieved.

D. Exemplary Embodiment, Method and System 2 (FIGS. 5A-B)

1. Embodiment 2 Generally

Figure 5A:
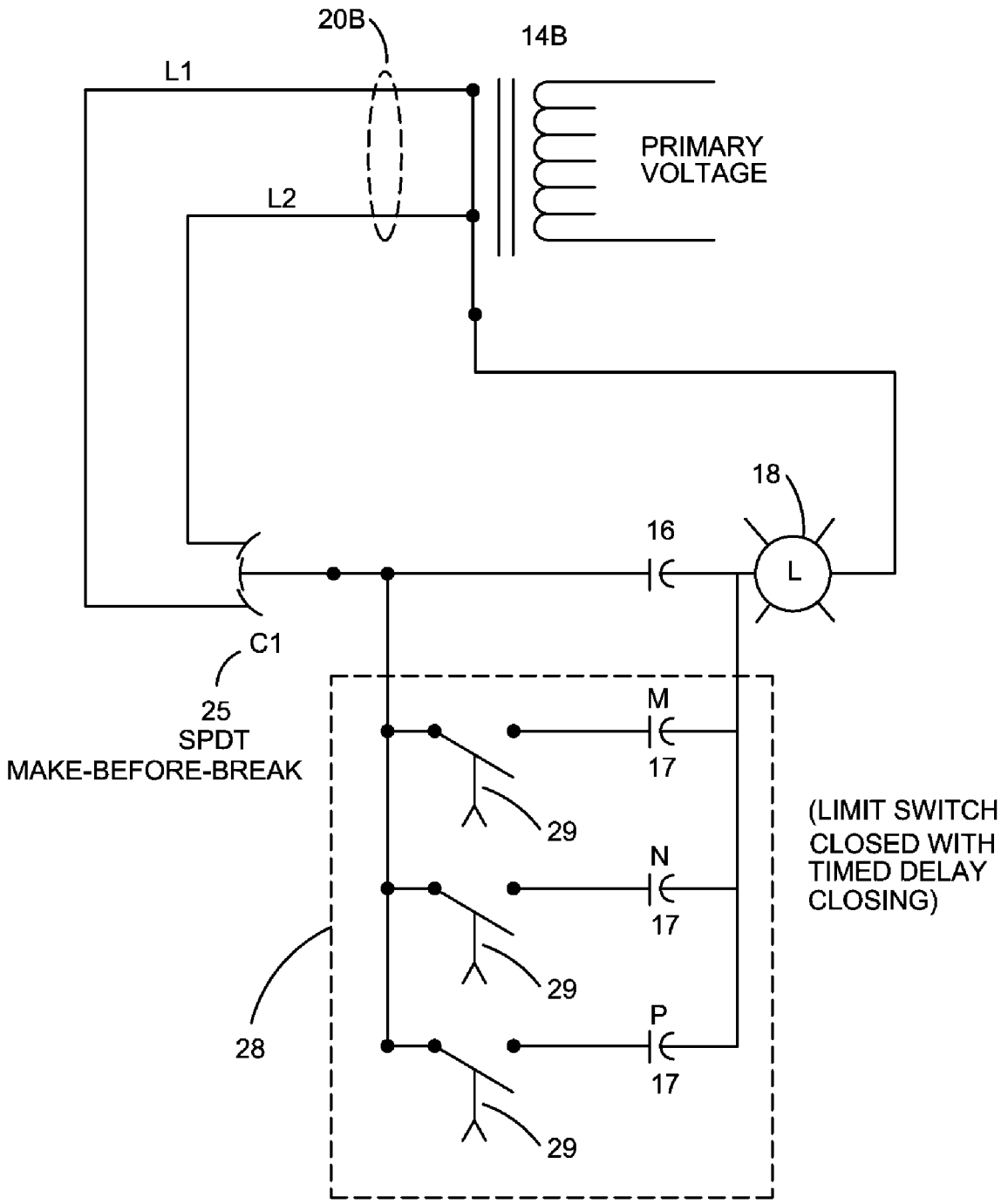
FIG. 5A is electrical diagram of an HID lighting circuit for an alternative embodiment 2 to provide constant light output with high and low operating modes using multiple ballast power taps and capacitance increases.
Figure 5B:
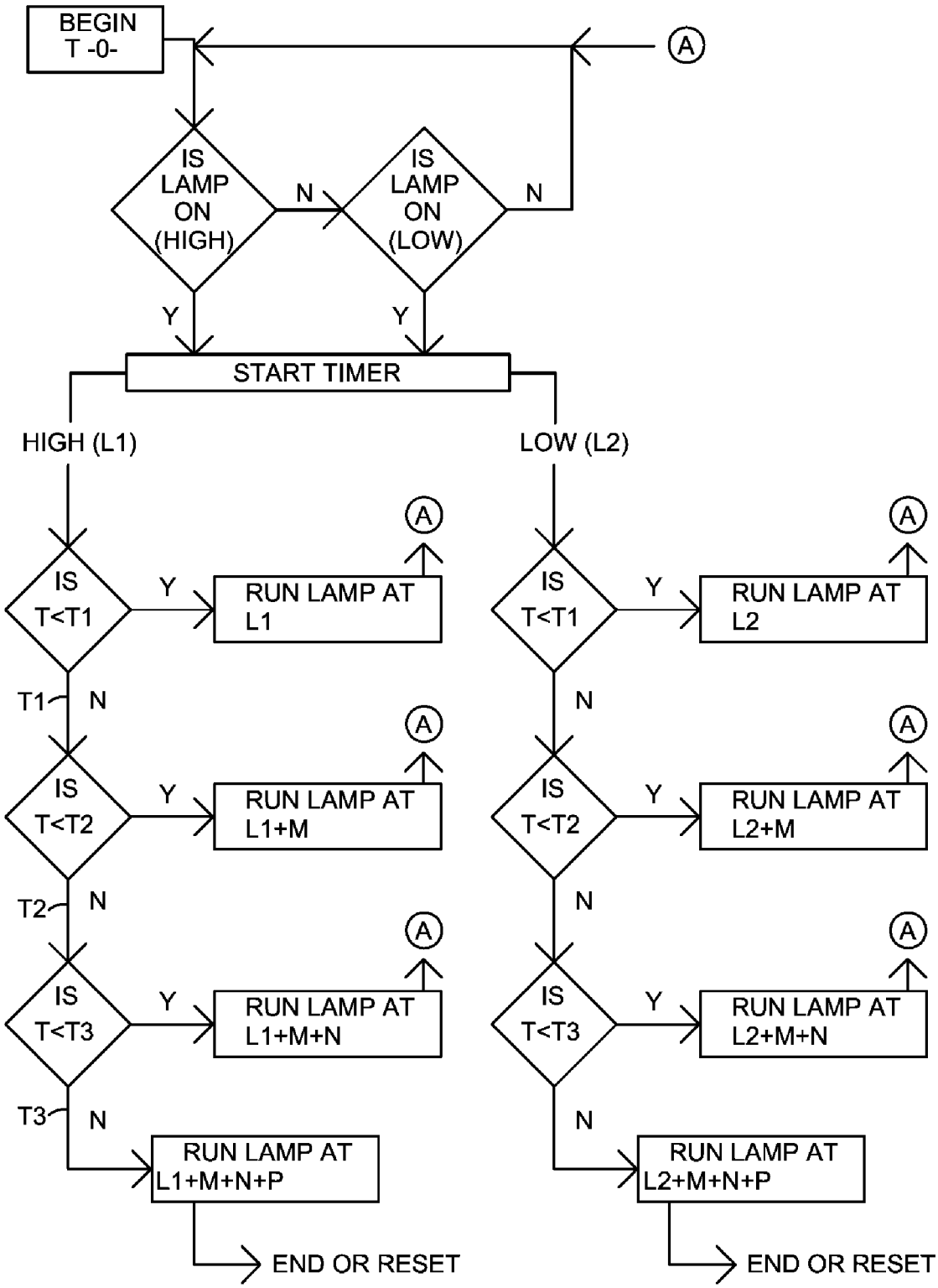
FIG. 5B is a flow chart for the method, apparatus and system of embodiment 2 to provide constant light output with high and low operating modes.

The second exemplary embodiment, FIG. 5A, utilizes ballast 14B with multiple secondary ballast power taps 20B, represented by output wattage variables L1 & L2, all controlled by single pole/double throw (SPDT) make-before-break switch 25. The ballast power taps 20B are wired in series with base or main capacitor 16, which in turn have the Smart Lamp™ circuit 28 wired in parallel to capacitor 16. This combination of ballast power tap 20B, capacitor 16, and Smart Lamp™ circuit 28 provides the correct operating wattage to the lamp 18 based on the time interval. Only one ballast power tap, L1 or L2, is used at any given time to power the lamp 18. Lamp 18 is connected to the output of capacitor 16 and the Smart Lamp™ circuit 28 and the common (COM) connection off ballast 14*b*. SPDT switch 25 is used to ensure make-before-break connections so the lamp operation is not interrupted.

The SPDT switch 25 can be controlled by many of the same systems described in the Smart Lamp™ circuit 28 of US2005/0184681 A1, which include but are not limited to electrical timers controlling contactors, remote communication to a contactor via Control-Link™ or similar control system, or photocell feedback that controls a contactor.

2. System of Embodiment 2

In this system utilizing embodiment 2, the constant light output is provided by increasing the amount of capacitance throughout the life of the lamp to compensate for lamp lumen depreciation. This method of increasing capacitance over time is described in the Smart Lamp™ concept of US2005/0184681 A1. This system also functions as a dimming circuit with a high mode and low mode. To provide a high and low operating mode, two secondary power taps 20B (L1 is higher, L2 is lower), FIG. 5A, are used with a switch 25 to control which circuit is operating. If low mode operating wattage L2 is lower than the recommended starting wattage, i.e. 1100 W for 1500 W lamps, then a timer circuit may need to be added to ensure the lamp 18 always starts in the high operating mode L1 and then switch to low L2 after 10 minutes or so. An example of a timing circuit is discussed in U.S. Pat. No. 4,994,718. Another method of controlling the operating mode is via remote control system, such as Musco's Control-Link™ (U.S. Pat. No. 6,681,110) or manually via a selector switch. This system provides constant light output for both operating modes with variable energy consumption. Other timing methods are discussed in US2005/0184681 A1.

3. Method of Embodiment 2

Referring to the flow chart for system 2, FIG. 5B, the method of operation will be discussed. During the initial startup of the system the time is set to zero, as represented by T0. When the lamp is powered on, the timer cumulates time. Based on the lumen depreciation curve of the light source, the timing function is configured to adjust the wattage to the lamp at key intervals. The time thresholds are set for the system and are represented by T1, T2 and T3. As the lamps operate, the cumulative time is monitored by the timing function. In this system the lamp can operate in two different modes, high mode represented by "L1" or low mode represented by "L2". When time, represented by "T", is between T0 and T1, the lamp operating wattage equals L2 for low mode and L1 for high mode. As time increases, T will equal or exceed T1, thus adjusting the lamp operating wattage to (L2)+M for low mode and (L1)+M for high mode. The value M is additional operating wattage created by the introduction of additional capacitance, over and above main or base capacitor 16, by switching in one of capacitors 17 in FIG. 5A. With additional operation, time will equal or exceed T2, adjusting the lamp operating wattage to (L2)+M+N for low mode and (L1)+M+N for high mode. When time "T" exceeds T3, the final lamp operating wattage is (L2)+M+N+P for low mode and (L1)+M+N+P for high mode. The lamp will continue to operate at wattages based on T3 regardless of actual time, until the lamps are replaced and the system time function is reset to T0. After which the process will repeat. In this method, the timing function continues regardless of which mode (high or low) the lamp operates in. Lamp lumen depreciation can be compensated for in either high or low mode (full or dimmed mode).

E. Exemplary Embodiment, Method and System 3 (FIGS. 6A-B)

1. Embodiment 3 Generally

The third exemplary embodiment, FIG. 6A, utilizes ballast 14B with multiple secondary power taps 20B, represented by output wattage variables L1 and L2, all controlled by make-before-break double pole/double throw (DPDT) switch 26. The L2 ballast power tap is wired in series to capacitor 16, which in turn is wired in series with lamp 18. When the DPDT switch 26 engages the L2 ballast power tap, the power provided to the lamp 18 bypasses the Smart Lamp™ circuit 28 and provides constant power to the lamp 18 regardless of the time interval. This will be referred to in system 3 as the "low mode". When DPDT switch 26 engages the L1 ballast power tap, the power provided to the lamp 18 includes capacitor 16 as well as the parallel Smart Lamp™ circuit 28 multiple capacitance options. The power provided to lamp 18 is adjusted over time to hold the lamp 18 output at near constant output. This will be referred to in system 3 as "normal" or "high mode". In this embodiment, the DPDT switch 26 can have make-before-break connections so the lamp operation is not interrupted.

The switch can be controlled by many of the same systems described in the Smart Lamp™ methods (US2005/0184681 A1), which include electrical timers controlling contactors, remote communication to a contactor via Control-Link™ or similar control system, or photocell feedback that controls a contactor.

2. System of Embodiment 3

In this system utilizing embodiment 3, two operating modes are provided. A normal operating circuit (high) and a lower mode operating circuit similar to system 2, except this arrangement provides constant wattage in the low mode and constant light in high mode. Thus, in the low mode, the energy consumption stays constant but the light level decreases over time due to lamp lumen depreciation. In the high mode, the wattage is increased over time via capacitance increases utilizing methods described in US2005/0184681 A1. Thus the light output is constant but the energy is variable.

This system uses a make-before-break double pole/double throw switch 26 to operate between high and low mode. When switched in the high mode, the power is routed through the Smart Lamp™ circuit 28 with variable capacitance. This provides the necessary power adjustments over time to hold the light output nearly constant. When in the low mode, power bypasses the Smart Lamp™ circuit and connects directly to the main capacitor. The method of control between high and low is the same as described in embodiment 2. In addition, the requirement stated in embodiment 2 to start in the high mode if the low mode was below the recommended starting wattage also pertains to this embodiment 3 system.

3. Method of Embodiment 3

Referring to the flow chart for embodiment three, FIG. 6B, the method of operation will be discussed. During the initial startup of the system, the time is set to zero, as represented by T0. When the lamp is powered on, the timer cumulates time.

Based on the lumen depreciation curve of the light source, the timing function is configured to adjust the wattage to the lamp at key intervals. The time thresholds are set for the system and are represented by T1, T2 and T3. As the lamps operate, the cumulative time is monitored by the timing function. In this system the lamp can operate in two different modes, high mode represented by "L1" or low mode represented by "L2". When time, represented by "T", is between T0 and T1, the lamp operating wattage equals L2 for low mode and L1 for high mode. As time increases, T will equal or exceed T1, thus adjusting the lamp operating wattage to (L1)+M for high mode, while the low mode will remain at L2. Additional capacitance "M" is added by closing limit switch 29 with time delay closing associated with top capacitor 17 in FIG. 6A. With additional operation, time will equal or exceed T2, adjusting the lamp operating wattage to (L1)+M+N for high mode, while the low mode will remain at L2. Middle capacitor 17, with capacitance "N", in FIG. 6A is added to the capacitance of main capacitor 16 and top capacitor 17 (capacitance "M") by closing of its switch 29 (capacitance "M" remains in the circuit—its switch or contactor remains closed). When time "T" exceeds T3, the final lamp operating wattage is (L1)+M+N+P for high mode, while the low mode will remain at L2 (all switches 29 are closed, bringing in all three capacitors 17 and their respective capacitances "M", "M" and "P"). The lamp will continue to operate at wattages based on T3 regardless of actual time, until the lamps are replaced and the system time function is reset to T0. After which the process will repeat. In this method, timing function continues regardless of which mode (high or low) the lamp operates in. However, the lamp wattage is only adjusted for the high mode to provide constant light output, while the low mode provides constant power, or energy.

Figure 7B:
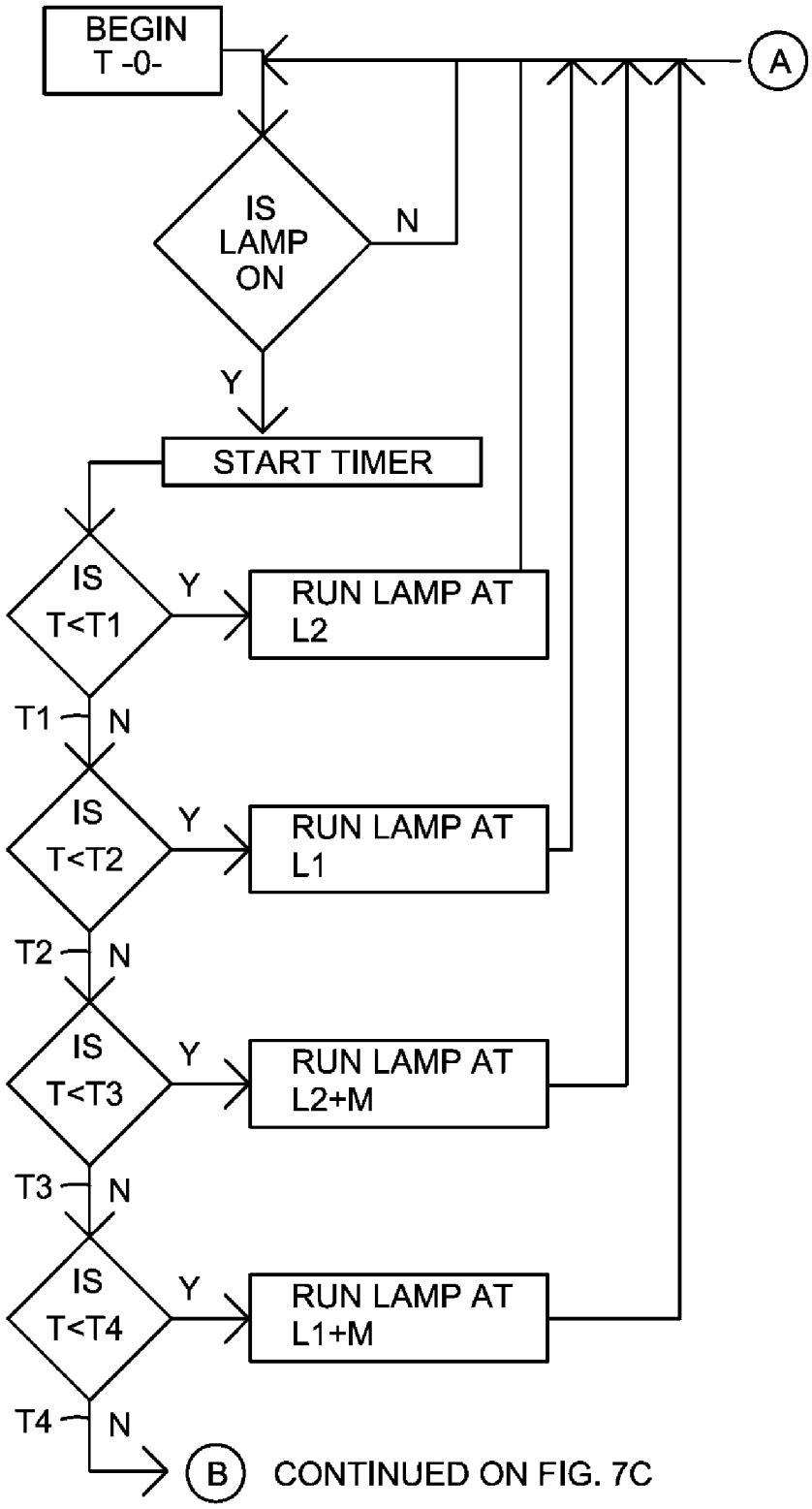
FIGS. 7B and 7C is a flow chart for embodiment, system and method 4 to provide constant light output with finer adjustment increments.
Figure 7C:
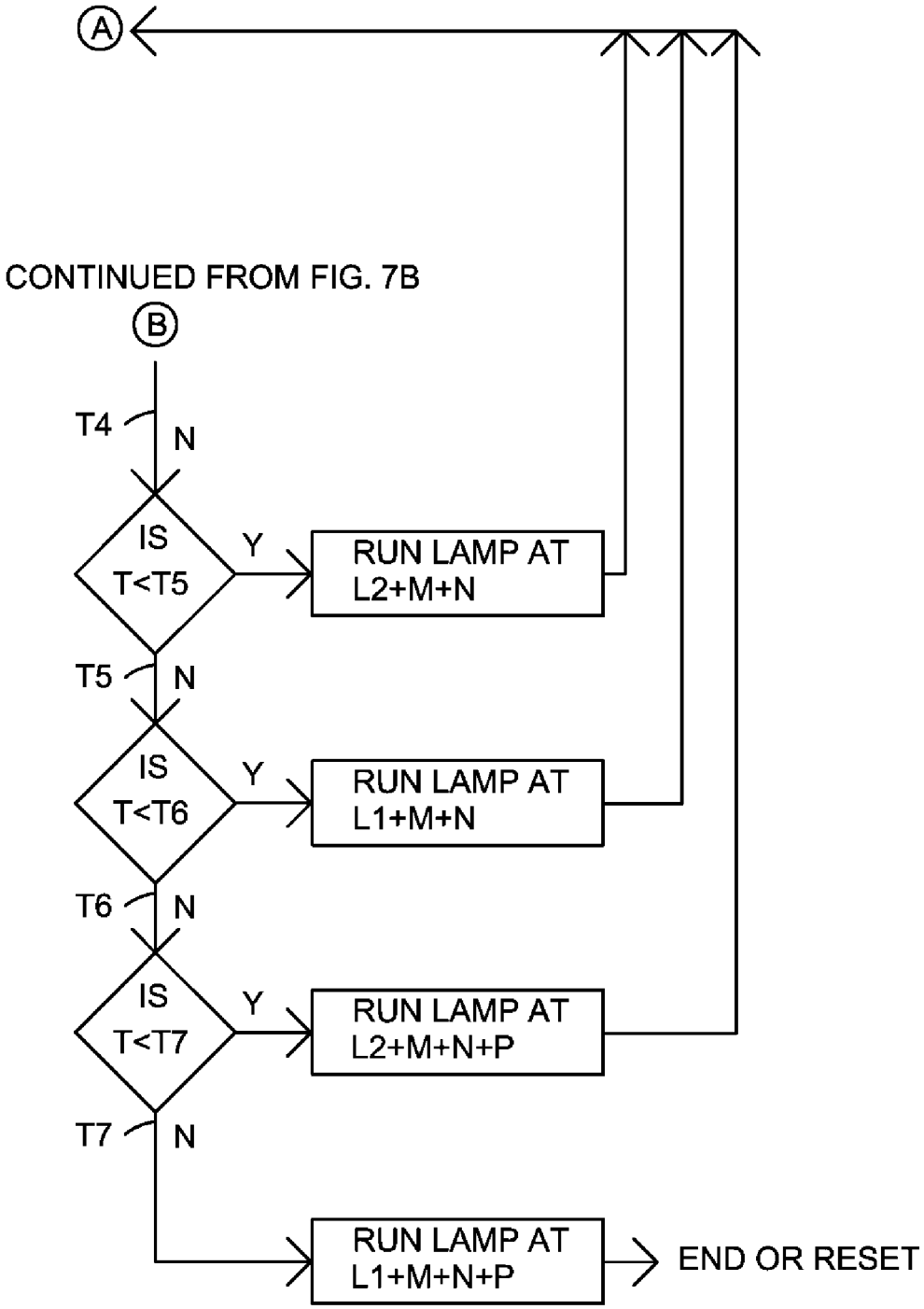

F. Exemplary Embodiment, Method and System 4 (FIGS. 7A-C)

1. Embodiment 4 Generally

Exemplary embodiment 4, FIG. 7A utilizes ballast 14B with multiple secondary power taps 20B, represented by L1 and L2, all controlled by single pole/double throw (SPDT) switch 24. The ballast power tabs 20B are wired in series with capacitor 16 and lamp 18, which connects to the common (COM) connection off of ballast 14B. The Smart Lamp™ circuit 28 is wired in parallel to capacitor 16 and provides additional power to the lamp based on the time intervals established in the Smart Lamp™ timer. Only one ballast power tab 20B is used at any given time to power lamp 18. In this embodiment, the system alternates between ballast power tap L1 and L2 based on the time intervals set. Like embodiment 1, when using SPDT switch 24 the switch point must occur during startup, not while lamps 18 are operating unless SPDT switch 25 (see FIG. 4B) is used with make-before-break connections.

The switches can be controlled by many of the same systems described in the Smart Lamp™ patent US2005/0184681 A1, which includes but is not limited to electrical timers controlling contactors, remote communication to a contactor via Control-Link™ or similar control system, or photocell feedback that controls a contactor.

2. System of Embodiment 4

In this system utilizing embodiment 4, the two power taps L1 and L2 are relatively close together in wattage. For example, the difference in wattage between the two power taps may be as little as five percent of the normal operating wattage. This system provides more constant light output with variable energy consumption. The constant light output is provided by a combination of increasing the amount of capacitance and/or increasing the power from the secondary side of the ballast throughout the life of the lamp to compensate for lamp lumen depreciation. By alternating between ballast power taps 20B, the number of power adjustments available double without requiring any additional capacitors 16 or 17. For example, if a typical Smart Lamp™ circuit provided four cycles, then this method used with Smart Lamp™ would provide eight cycles of finer adjustment.

Like the previous embodiment 2, a single pole/double throw switch is used to control which ballast power tap is used to supply power. Control of this switch is the same as described in embodiment 2. The preferred method of control is Musco's Control-Link™ system that will switch the circuits as needed based on the operating hours of the system. The following will describe the basic operation of this system using Control-Link™ as the switching method. However other switching methods will apply as well.

When the system is new, and during the initial start-up, the system will operate at its lowest wattage L2; in this case "mode one" with the single main or base capacitance 16. After a period of operation, perhaps one hundred hours or so, the switch will transfer to the second power tap at a slightly higher wattage L1, thus increasing the light output to hold the light output closer to the designed illumination level. For the third cycle, the system will switch back to the first ballast power tap L2, and Smart Lamp™ electromechanical timer with cam switches will engage the first capacitance increase (by switching in capacitance "M"). The fourth cycle will switch to the second ballast power tap L1 and use the additional capacitance M that was engaged in the previous cycle. This process continues alternating between L2 and L1 and sequentially adding additional capacitance "N" and "P" throughout the entire life of the lamp to hold the light output constant. The benefit of this method over typical Smart Lamp™ is that the light output is held more constant, or is held at a nearby constant level with less deviation from the norm. This is because there are more choices and thus more "bump ups" in wattage possible over the life of the lamp. As explained in US2005/0184681 A1, in many Smart Lamp™ embodiments light output is not straight-line constant, but drops slowly and then is restored to nominal value, drops slowly and then restored or returned to nominal value, etc.—more of a saw-tooth line when graphed. If bump-ups can be more frequent, such as with this embodiment, light output is closer to straight line constant.

3. Method of Embodiment 4

Referring to the flow chart for embodiment four, FIGS. 7B and 7C, the method of operation will be discussed. During the initial startup of the system, the time is set to zero, as represented by T0. When the lamp is powered on, the timer cumulates time. Based on the lumen depreciation curve of the light source, the timing function is configured to adjust the wattage to the lamp at key intervals. The time thresholds are set for the system and are represented by T1 through T7. As the lamps operate, the cumulative time is monitored by the timing function. In this system, each lamp 18 operates in a single mode but the system alternates power adjustment to the lamp between the ballast secondary power taps and by adding capacitance. The two ballast power taps are represented by "L1" and "L2". When time, represented by "T", is between T0 and T1 (T<T1), the lamp operating wattage equals L2 (the lower level or mode). As time increases, T will exceed T1 but is less than T2, thus adjusting the lamp operating wattage to L1 (higher than L2). With additional operation, time will equal or exceed T2 but is less than T3, adjusting the lamp operating wattage to (L2)+M. When time T exceeds T3 but is less than T4, the lamp operating wattage is adjusted to (L1)+M. When time T exceeds T4 but is less than T5, the lamp operating wattage is adjusted to (L2)+M+N. When time T exceeds T5 but is less than T6, the lamp operating wattage is adjusted to (L1)+M+N. When time T exceeds T6 but is less than T7, the lamp operating wattage is adjusted to (L2)+M+N+P. When time T exceeds T7, the lamp operating wattage is adjusted to (L1)+M+N+P. The lamp will continue to operate at wattages based on T exceeding T7, regardless of actual time, until the lamps are replaced and the system time function is reset to T0; after which the process will repeat.

G. Exemplary Embodiment, Method and System 5 (FIGS. 8A-E)

1. Embodiment 5 Generally

The exemplary embodiment 5, FIG. 8A, utilizes ballast 14B with multiple (three) secondary ballast power taps 20B, represented by output wattage variables L1, L2 and L3, all controlled by two single pole/double throw (SPDT) switches 24. The ballast power taps 20B are wired in series with single base or main capacitor 16 and lamp 18, which is connected to the common (COM) connection on ballast 14B. In addition, Smart Lamp™ circuit 28 is wired in parallel to capacitor 16 to provide additional power based on the time intervals set in the Smart Lamp™ circuit 28. Only one ballast power tap 20B is used at any given time to provide the correct operating wattage to lamp 18 based on the time interval. Like alternative embodiment 1, when using SPDT switches 24 the switch point must occur during startup, not while lamps 18 are operating unless SPDT switch 25, FIG. 8B, is used with make-before-break connection.

The switches can be controlled by many of the same systems described in the Smart Lamp™ method, which include but are not limited to, electrical timers controlling contactors, remote communication to a contactor via Control-Link™ or similar control system, or photocell feedback that controls a contactor.

2. System of Embodiment 5

In this system utilizing embodiment 5, the three power taps L1, L2, and L3 are relatively close together in wattage. For example, the difference in wattage between the three power taps may be as little as three percent of the normal operating wattage. This system provides even more constant light output than the system of embodiment 4. The nearly constant light output is provided by a combination of increasing the amount of capacitance and/or increasing the power from the secondary side of the ballast throughout the life of the lamp to compensate for lamp lumen depreciation. By alternating between ballast power taps 20B, the number of power adjustments available triple without requiring any additional capacitors 16 or 17. For example, if a typical Smart Lamp™ circuit provided four cycles, then this system, used with Smart Lamp™, would provide twelve cycles of finer adjustment.

This system uses multiple switches 24 or 25 for the ballast power taps 20B, similar to embodiment 1, only in combination with Smart Lamp™ technology for capacitance increases. Control of switches 24 or 25 is the same as described in embodiment 2. A method of control is Musco's Control-Link™ system which will switch the circuits as needed based on the operating hours of the system.

The following will describe the basic operation of this method using Control-Link™ (U.S. Pat. No. 6,681,110) as the switching method, however other switching methods will apply as well. When the system is new, and during the initial start-up, the system will operate at its lowest wattage L3, in this case mode one with the single main capacitance 16. After a period of operation, perhaps one hundred hours or so, the switch will transfer to the second power tap at a slightly higher wattage L2, thus increasing the light output to hold the light output closer to the designed illumination level. In the third cycle the switch will transfer to the third power tap at a slightly higher wattage L1, still using same capacitance from the main capacitor 16. In the fourth cycle, the system will switch back to the first ballast power tap L3 and Smart Lamp™ electromechanical timer (see US2005/0184681 A1) with cam switches will engage the first capacitance increase "M". The fifth cycle will switch to the second ballast power tap L2 and use the additional capacitance M that was engaged in the previous cycle four. The sixth cycle will switch to the third ballast power tap L1 and continue to use the same capacitance level M. The seventh cycle restarts at the first ballast power tap L3, but engages and adds (to capacitance from capacitor 16 and capacitance "M") the next capacitance level "N". This process continues cycling sequentially between L3, L2, and L1, and adding capacitance throughout the entire life of the lamp to hold the light output constant. The benefit of this method over typical Smart Lamp™ is that the light output is held more constant, or is held at nearly constant level with less deviation from the norm.

3. Method of Embodiment 5

Referring to the flow chart for embodiment 5, FIGS. 8C, 8D and 8E, the method of operation will be discussed. During the initial startup of the system, the time is set to zero, as represented by T0. When the lamp is powered on, the timer cumulates time. Based on the lumen depreciation curve of the light source, the timing function is configured to adjust the wattage to the lamp at key intervals. The time thresholds are set for the system and are represented by T1 through T11. As the lamps operate, the cumulative time is monitored by the timing function. In this system the lamp operates in a single mode, but the system alternates power adjustment to the lamp between the ballast secondary power taps and adding capacitance. The three ballast power taps are represented by "L1", "L2" and "L3". When time, represented by "T" is between T0 and T1 (T<T1), the lamp operating wattage equals L3 (lowest). As time increases, T will exceed T1 but is less than T2, thus adjusting the lamp operating wattage to L2 (intermediate). With additional operation, time will equal or exceed T2 but is less than T3, adjusting the lamp operating wattage to L1. When time T exceeds T3 but is less than T4, the lamp operating wattage is adjusted to (L3)+M. When time T exceeds T4 but is less than T5, the lamp operating wattage is adjusted to (L2)+M. When time T exceeds T5 but is less than T6, the lamp operating wattage is adjusted to (L1)+M. When time T exceeds T6 but is less than T7, the lamp operating wattage is adjusted to (L3)+M+N. When time T exceeds T7 but is less than T8, the lamp operating wattage is adjusted to (L2)+M+N. When time T exceeds T8 but is less than T9, the lamp operating wattage is adjusted to (L1)+M+N. When time T exceeds T9 but is less than T10, the lamp operating wattage is adjusted to (L3)+M+N+P. When time T exceeds T10 but is less than T11, the lamp operating wattage is adjusted to (L2)+

M+N+P. When time T exceeds T11, the lamp operating wattage is adjusted to (L1)+M+N+P. The lamp will continue to operate at wattages based on T exceeding T11 regardless of actual time, until the lamps are replaced and the system time function is reset to T0. After which the process will repeat.

H. Exemplary Embodiment, Method and System 6 (FIGS. 9A-C)

1. Embodiment 6 Generally

The sixth exemplary embodiment, FIG. 9A, utilizes ballast 14B with multiple secondary power taps 20B, represented by output wattage variables L1, L2 and L3, all controlled by make-before-break single pole/triple throw (SP3T) switch 25. The ballast power taps 20B are wired in series with single main or base capacitor 16 and to lamp 18, which is connected to the common (COM) connection on ballast 14*b*. In addition, Smart Lamp™ circuit 28 is wired in parallel to capacitor 16 to provide additional power to lamp 18 based on the time intervals set in the Smart Lamp™ circuit 28. Only one ballast power tap 20B is used at any given time to provide the correct operating wattage to lamp 18 based on the time interval.

The switches can be controlled by many of the same systems described in the Smart Lamp™ patent (US2005/0184681 A1(, which include electrical timers controlling contactors, remote communication to a contactor via Control-Link™ (U.S. Pat. No. 6,681,110) or similar control system, or photocell feedback that controls a contactor. The SP3T switch 25 is used to ensure make-before-break connections so the lamp operation is not interrupted.

2. System of Embodiment 6

This system utilizing embodiment 6 combines the dimming concept from system 2 with fine increments of power adjustment from system 4. This provides nearly constant light output for both modes, with finer increments of adjustment in the high mode. The energy consumption is variable in both modes.

A single pole/tripe throw switch 25 is used to control which ballast power tap 20B (L1, L2, or L3) is used to supply power. Control of this switch is the same as described in embodiment 5, see FIG. 8B. The preferred method of control is Musco's Control-Link™ system (U.S. Pat. No. 6,681,110) that will switch the circuits as needed based on the operating hours of the system and the operating mode.

The following will describe the basic operation of this method using Control-Link™ as the switching method, however other switching methods will apply as well. When the system is new, and during the initial start-up, the system will operate at its lowest wattage in high mode, in this case the power tap 20B associated with L2 (intermediate wattage) with the single main capacitance 16. After a period of operation, perhaps one hundred hours or so, the switch will transfer to the third power tap L1 (highest) at a slightly higher wattage than L2, thus increasing the light output to hold the light output closer to the designed illumination level. For the third cycle, the system will switch back to the second ballast power tap L2 and Smart Lamp™ electromechanical timer (US2005/0184681 A1) with cam switches will engage the first capacitance increase M. The fourth cycle will switch to the third ballast power tap L1 and use the additional capacitance M that was engaged in the previous cycle. This process for high mode continues as indicated on the left side of FIGS. 9B-C throughout the entire life of the lamp to hold the light output constant in the high mode. The benefit of this method over typical Smart Lamp™ is that the light output is held more constant, or is held at nearly constant level with less deviation from the norm.

For low mode operation (dimming), the switch transfers power from the first ballast power tap L3 (lowest wattage). Similar to embodiment 2, if the low mode starting wattage is too low, then the system must start in the high mode and then switch to the low mode. While in the low mode, the circuit 28 uses the Smart Lamp™ cam timer (US2005/0184681 A1) for periodic step-up in capacitance to the lamp circuit to periodically increase operating power to the lamp to compensate for LLD.

3. Method of Embodiment 6

Referring to the flow chart for embodiment 6, FIGS. 9B and 9C, the method of operation will be discussed. During the initial startup of the system, the time is set to zero, as represented by T0. When the lamp is powered on, the timer cumulates time. Based on the lumen depreciation curve of the light source, the timing function is configured to adjust the wattage to the lamp at key intervals. The time thresholds are set for the system and are represented by T1, T2 and T3. As the lamps operate, the cumulative time is monitored by the timing function. In this system the lamp can operate in two different modes; high mode represented by "L2" and "L1" or low mode represented by "L3". When time, represented by "T", is between T0 and T1, the lamp operating wattage equals L3 for low mode and L2 for high mode. As time increases, T will exceed T1 but is less than T2, thus adjusting the lamp operating wattage to (L1) for high mode, while the low mode will remain at L3. With additional operation, time will exceed T2 but is less than T3, adjusting the lamp operating wattage to (L2)+M for high mode, while the low mode will adjust to (L3)+M. When time "T" exceeds T3 but is less than T4, thus adjusting the lamp operating wattage to (L1)+M for high mode, while the low mode will remain at (L3)+M. With additional operation, time will exceed T4 but is less than T5, adjusting the lamp operating wattage to (L2)+M+N for high mode, while the low mode will adjust to (L3)+M+N. When time "T" exceeds T5 but is less than T6, thus adjusting the lamp operating wattage to (L1)+M+N for high mode, while the low mode will remain at (L3)+M+N. With additional operation, time will exceed T6 but is less than T7, adjusting the lamp operating wattage to (L2)+M+N+P for high mode, while the low mode will adjust to (L3)+M+N+P. When time "T" exceeds T7 the lamp operating wattage adjusts to (L1)+M+N+P for high mode, while the low mode will remain at (L3)+M+N+P. The lamp will continue to operate at wattages based on T7 regardless of actual time, until the lamps are replaced and the system time function is reset to T0. After which the process will repeat. In this method, timing function continues regardless of which mode (high or low) the lamp operates in.

I. Exemplary Embodiment, Method and System 7 (FIGS. 10A-C)

1. Embodiment 7 Generally

The seventh exemplary embodiment, FIG. 10A, utilizes ballast 14B with multiple secondary power taps 20B, represented by output wattage variables L1, L2 and L3, all controlled by make-before-break single pole/double throw switch 25 and make-before-break double pole/double throw switch 26. The ballast power taps 20B are wired in series with single capacitor 16 and to lamp 18, which is connected to the common (COM) connection on ballast 14B. When the DPDT switch 26 engages the L3 (lowest secondary-side wattage) ballast power tap, the power provided to the lamp 18 bypasses the Smart Lamp™ circuit 28 and utilizes only capacitor 16 to provide constant power to the lamp 18 regardless of the time interval. This will be referred to in system 7 as the "low mode". When SPDT switch 25 engages the L2 or L3 ballast power tap, the power provided to the lamp 18 includes capacitor 16 as well as the parallel Smart Lamp™ circuit 28 capacitance options. The power provided to lamp 18 is adjusted over time to hold the lamp 18 output at nearly constant output. This will be referred to in system 7 as "normal" or "high" mode. The SPDT switch 25 and DPDT switch 26 are used to ensure make-before-break connections so the lamp operation is not interrupted.

The switches can be controlled by many of the same systems described in the Smart Lamp™ patent (US2005/0184681 A1), which include electrical timers controlling contactors, remote communication to a contactor via Control-Link™ (U.S. Pat. No. 6,681,110) or similar control system, or photocell feedback that controls a contactor.

2. System of Embodiment 7

This system provides constant wattage in the low mode and constant light in high mode with fine adjustment increments. Thus in the low mode, the energy consumption stays constant but the light level decreases over time due to lamp lumen depreciation. In the high mode, the wattage is increased over time via capacitance increases utilizing methods described in US2005/0184681 A1. Thus the light output is nearly constant but the energy is variable.

This system uses a double pole/double throw switch 26 to operate between high and low mode, similar to embodiment 3. When switched in the high mode, the power is routed through the Smart Lamp™ circuit with variable capacitance. When in the low mode, power bypasses the Smart Lamp™ circuit and connects directly to the main capacitor 16. Control of this switch is the same as described in embodiment 2 and 5. A method of control is Musco's Control-Link™ system that will switch the circuits as needed based on the operating hours of the system and the operating mode. In addition, the requirement stated in embodiment 2 to start in the high mode if the low mode was below the recommended starting wattage also pertains to this method.

When operating in high mode, a SPDT switch 25 will alternate between ballast power tap L2 and L3, which are connected in series to the Smart Lamp™ circuit. This provides constant light output in the high mode with fine adjustment increments.

The following will describe the basic operation of this method using Control-Link™ as the switching method, however other switching methods will apply as well. When the system is new, and during the initial start-up, the system will operate at its lowest wattage in the high mode, in this case power tap two (L2) with the single main capacitance 16. After a period of operation, perhaps one hundred hours or so, the switch will transfer to the third power tap (L1) at a slightly higher wattage than L2, thus increasing the light output to hold the light output closer to the design illumination level. For the third cycle, the system will switch back to the second ballast power tap L2 and Smart Lamp™ electromechanical timer with cam switches will engage the first capacitance increase M. The fourth cycle will switch to the third ballast power tap L1 and use the additional capacitance M that was engaged in the previous cycle. This process continues as indicated in FIGS. 10B-C throughout the entire life of the lamp to hold the light output constant in the high mode. This is the same process as the high mode for embodiment 6. The benefit of this method over typical Smart Lamp™ is that the light output is held more constant, or is held at nearly constant level with less deviation from the norm.

For low mode operation (dimming), the switch transfers power to the first ballast power tap L3. Similar to embodiment two, if the low mode starting wattage L3 is too low, then the system must start in the high mode and then switch to the low mode. While in the low mode, the circuit bypasses the Smart Lamp™ circuit and connects directly to the main capacitor 16. Thus, no power adjustments are made to compensate for lumen depreciation in the low mode.

3. Method of Embodiment 7

Referring to the flow chart for embodiment 7, FIGS. 10B and 10C, the method of operation will be discussed. During the initial startup of the system the time is set to zero, as represented by T0. When the lamp is powered on, the timer cumulates time. Based on the lumen depreciation curve of the light source, the timing function is configured to adjust the wattage to the lamp at key intervals. The time thresholds are set for the system and are represented by T1-T7. As the lamps operate, the cumulative time is monitored by the timing function. In this system the lamp can operate in two different modes, high mode represented by "L2" and "L1" or low mode represented by "L3". When time, represented by "T" is between T0 and T1, the lamp operating wattage equals L3 for low mode and L2 for high mode. As time increases, T will exceed T1 but be less than T2, thus adjusting the lamp operating wattage to L1 for high mode, while the low mode will remain at L3. With additional operation, time exceeds T2, but is less than T3, adjusting the lamp operating wattage to (L2)+M for high mode, while the low mode will remain at L3. With additional operation, time exceeds T3, but is less than T4, adjusting the lamp operating wattage to (L1)+M for high mode, while the low mode will remain at L3. With additional operation, time exceeds T4, but is less than T5, adjusting the lamp operating wattage to (L2)+M+N for high mode, while the low mode will remain at L3. With additional operation, time exceeds T5, but is less than T6, adjusting the lamp operating wattage to (L1)+M+N for high mode, while the low mode will remain at L3. With additional operation, time exceeds T6, but is less than T7, adjusting the lamp operating wattage to (L2)+M+N+P for high mode, while the low mode will remain at L3. With additional operation, time exceeds T7, adjusting the lamp operating wattage to (L1)+M+N+P for high mode, while the low mode will remain at L3. The lamp will continue to operate at wattages based on T7 regardless of actual time, until the lamps are replaced and the system time function is reset to T0. After which the process will repeat. In this method, timing function continues regardless of which mode (high or low) the lamp operate in. However, the lamp wattage is only adjusted for the high mode to provide constant light output, while the low mode provides constant power or energy.

Uses and Application

Many commercial and recreational facilities utilize high intensity discharge lamps that have the inherent characteristic of decreasing light output as the lamp operates. This loss in light requires significant "over-lighting," to ensure the minimum levels are achieved, or early lamp maintenance, i.e. replacement. These deficiencies are solved by use of the above embodiments that provide constant light output. One such application in particular is sport lighting.

Another application is for facilities that require different operating modes based on the use of the facility. For example, a sports field may require high levels of light output for tournament play, but can utilize less light for practice or field clean-up. This is typically referred to as dimming mode. The above embodiments provide options for dimming the light level at constant level or allowing the lower light level to depreciate over time. For dimming applications that have established minimum levels for both the high mode and the low mode, then constant light output in both modes is desirable. However, if minimum requirements for the low mode are less stringent, then constant wattage (energy consumption) in the low mode, with constant light output in the high mode is desirable. This application will save additional energy expense over constant light output.

What is claimed is:

1. A method of controlling operation of an HID lamp connected in series with a first source of capacitance and ballasted by a ballast having a primary side and a secondary side comprising:

a. providing a plurality of power level connections on the secondary side of the ballast so that a plurality of power levels are available on the secondary side;

b. connecting the first source of capacitance to one of the power level connections on the secondary side of the ballast;

c. so that plural levels of operating wattage are available to power the lamp to provide substantially constant light output over cumulative lamp operating time by periodic increases in power to the lamp or discretionarily dim the lamp by reducing power to the lamp.

2. The method of claim 1 wherein the HID lamp is a metal halide HID lamp.

3. The method of claim 1 further comprising one or more additional sources of capacitance are connected in parallel with the first source of capacitance and available for operative connection to the lamp.

4. The method of claim 3 wherein the one or more sources of additional capacitance are selectively addable to the first source of capacitance.

5. The method of claim 4 wherein the selective addition of additional capacitance is through one or more switches.

6. The method of claim 5 wherein the one or more switches are single-pole, single throw switches.

7. The method of claim 6 wherein the switches are make-before-break switches.

8. The method of claim 4 further comprising selecting between levels of capacitance to the lamp to change light output of the lamp for dimming purposes.

9. The method of claim 4 further comprising selecting between levels of capacitance to the lamp to compensate for lamp lumen depreciation of the lamp.

10. The method of claim 9 wherein a lower power level connection on the secondary side of the ballast is selected for a low or dimmed light level mode without ability to alter level of capacitance to the lamp, and a higher power level connection on the secondary side of the ballast is selected for a high or full light level mode with the ability to alter level of capacitance to the lamp.

11. The method of claim 10 wherein low mode is for dimming of light output but at relatively constant power consumption and high mode is for full light output but periodic increase in power consumption by adding capacitance to the lamp to compensate for lamp lumen depreciation.

12. The method of claim 1 further comprising selecting between power level connections of the secondary side of the ballast to change light output of the lamp for dimming purposes.

13. The method of claim 1 further comprising additionally selecting between levels of capacitance to the lamp to change light output of the lamp for dimming purposes.

14. The method of claim 1 further comprising periodically increasing power consumption of the lamp to increase light output of the light to compensate for lamp lumen depreciation of the lamp.

15. The method of claim 1 wherein the first source of capacitance is under rated operating wattage (ROW) for the lamp.

16. The method of claim 1 wherein the at least one power level connection produces power at the lamp which is under ROW for the lamp.

17. The method of claim 1 wherein the first source of capacitance and the at least one power level connection produces power at the lamp under ROW for the lamp.

18. An apparatus for controlling operation of an HID lamp connected in series with a first source of capacitance and ballasted by a ballast having a primary side and a secondary side comprising:

a. a plurality of power level connections on the secondary side of the ballast so that a plurality of powers are available on the secondary side;

b. a switching mechanism adapted to connect the first source of capacitance to one of the power level connections on the secondary side of the ballast;

c. so that plural levels of operating wattage are available to power the lamp to provide substantially constant light output over cumulative lamp operating time by periodic increases in power to the lamp or discretionary dim the lamp by reducing power to the lamp.

19. The apparatus of claim 18 wherein the number of power level connections on the secondary side comprises a plurality.

20. The apparatus of claim 18 wherein at least some of the power level connections provide power output levels that are spaced relatively far apart.

21. The apparatus of claim 18 wherein at least some of the power level connections provide power output levels that are spaced relatively close together.

22. The apparatus of claim 18 further comprising a second capacitor switchably connectable in parallel with the first source of capacitance.

23. The apparatus of claim 22 further comprising a third capacitor switchably connectable in parallel with the first source of capacitance and second capacitor.

24. The apparatus of claim 23 further comprising a fourth capacitor switchably connectable in parallel with the first source of capacitance, the second and the third capacitors.

25. The apparatus of claim 18 wherein the switching mechanism allows selection between a plurality of levels of electrical power to the lamp.

26. The apparatus of claim 25 wherein a first level of electrical power is a relatively low level for dimming the light output of the lamp from full power.

27. The apparatus of claim 26 wherein the first level of electrical power is at a relatively constant power level.

28. The apparatus of claim 26 wherein a second level of electrical power corresponds with full light output for the lamp.

29. The apparatus of claim 26 wherein a third or more levels of electrical power correspond with other levels of light output for the lamp for multiple dimming options for the lamp.

30. The apparatus of claim 18 wherein the switching mechanism comprises a relay or contactor.

31. The apparatus of claim 18 wherein the switching mechanism comprises one of a single-pole, single-throw switch, or a single-pole, double-throw switch.

32. The apparatus of claim 18 wherein the switching mechanism comprises a make-before-break switch.

33. The apparatus of claim 18 in combination with a main source of electrical power.

34. The apparatus of claim 18 further comprising a remote control operatively connected to the switching mechanism and adapted to remotely select connection to a power level connection on the secondary side of the ballast and/or switch connections.

35. The apparatus of claim 18 further comprising a sensor operatively positioned or connected to the apparatus to monitor an operational function or parameter related to the apparatus and producing a signal which is communicated to a remote station.

36. An apparatus for adjusting light output of an HID lamp in series with a first capacitor with power provided through a ballast having primary and secondary sides comprising:

a. multiple switchable power level connections on the secondary side of ballast adapted for operative connection to the lamp and first capacitor;

b. a switching mechanism having a control input adapted to switch between the power level connections;

c. multiple switchable capacitance in operative connection to the lamp and the first capacitor; and d. wherein the multiple switchable capacitance is adapted for selectable power increases to the lamp to compensate for lamp lumen depreciation over time.

37. The apparatus of claim 36 wherein the multiple switchable power level connections are adapted for selectable dimming of light output of the lamp.

38. An apparatus for controlling the power signal to an HID light source comprising:

a. a ballast with multiple power level connections, where the connections do not output the same power signal;

b. at least one capacitor operatively connected to the HID light source to control the power supplied to the light source;

c. wherein the ballast power level connections are switchably connected to the at least one capacitor for selective power increases to the lamp or discretionary dimming of the lamp.

39. The apparatus of claim 38 wherein there are multiple capacitors.

40. The apparatus of claim 39 wherein the multiple capacitors can be switched onto the circuit individually or in combination.

41. The apparatus of claim 40 wherein a switch makes a new connection before it breaks the previous connection.

42. An apparatus for controlling operation of an HID lamp connected in series with a first source of capacitance and ballasted by a ballast having a primary side and a secondary side comprising:

a. a plurality of power level connections on the secondary side of the ballast so that a plurality of power levels are available on the secondary side;

b. a switching mechanism adapted to connect the first source of capacitance to one of the power level connections on the secondary side of the ballast so that plural levels of operating wattage are available to power the lamp;

c. a remote control operatively connected to the switching mechanism and adapted to remotely select connection to a power level connection on the secondary side of the ballast for selective power increases to the lamp or discretionary dimming of the lamp.

43. An apparatus for controlling operation of an HID lamp connected in series with a first source of capacitance and ballasted by a ballast having a primary side and a secondary side comprising:

a. a plurality of power level connections on the secondary side of the ballast so that a plurality of power levels are available on the secondary side;

b. a switching mechanism adapted to connect the first source of capacitance to one of the power level connections on the secondary side of the ballast so that plural levels of operating wattage are available to power the lamp;

c. a sensor operatively positioned on or connected to monitor an operational function or parameter related to the apparatus and producing a signal which is communicated to a remote station.

44. A method of controlling operation of an HID lamp connected in series with a first source of capacitance and ballasted by a ballast having a primary side and a secondary side comprising:

a. providing a plurality of power level connections on the secondary side of the ballast so that a plurality of power levels are available on the secondary side;

b. connecting the first source of capacitance to one of the power level connections on the secondary side of the ballast;

c. so that plural levels of operating wattage are available to power the lamp; and d. periodically increasing power consumption of the lamp to increase light output of the light to compensate for lamp lumen depreciation of the lamp.

45. A method of controlling operation of an HID lamp connected in series with a first source of capacitance and ballasted by a ballast having a primary side and a secondary side comprising:

a. providing a plurality of power level connections on the secondary side of the ballast so that a plurality of power levels are available on the secondary side;

b. connecting the first source of capacitance to one of the power level connections on the secondary side of the ballast;

c. so that plural levels of operating wattage are available to power the lamp;

d. one or more additional sources of capacitance are connected in parallel with the first source of capacitance and available for operative connection to the lamp;

e. wherein the one or more sources of additional capacitance is selectively addable to the first source of capacitance;

f. selecting between levels of capacitance to the lamp to compensate for lamp lumen depreciation of the lamp;

g. wherein a lower power level connection on the secondary side of the ballast is selected for a low or dimmed light level mode without ability to alter level of capacitance to the lamp, and a higher power level connection on the secondary side of the ballast is selected for a high or full light level mode with the ability to alter level of capacitance to the lamp;

h. wherein low mode is for dimming of light output but at relatively constant power consumption and high mode is for full light output but periodic increase in power consumption by adding capacitance to the lamp to compensate for lamp lumen depreciation.

46. An apparatus for controlling operation of an HID lamp connected in series with a first source of capacitance and ballasted by a ballast having a primary side and a secondary side comprising:

a. a plurality of power level connections on the secondary side of the ballast so that a plurality of powers are available on the secondary side;

b. a switching mechanism adapted to connect the first source of capacitance to one of the power level connections on the secondary side of the ballast;

c. so that plural levels of operating wattage are available to power the lamp; and d. a sensor operatively positioned or connected to the apparatus to monitor an operational function or parameter related to the apparatus and producing a signal which is communicated to a remote station.

* * * * *

UNITED STATES PATENT AND TRADEMARK OFFICE

CERTIFICATE OF CORRECTION

PATENT NO. : 7,982,404 B2
APPLICATION NO. : 11/932560
DATED : July 19, 2011
INVENTOR(S) : Gordin It is certified that error appears in the above-identified patent and that said Letters Patent is hereby corrected as shown below:

Column 20, Line 34
DELETE: "discretionary"
ADD: --discretionarily--

Signed and Sealed this
Twenty-seventh Day of September, 2011

David J. Kappos
*Director of the United States Patent and Trademark Office*